US008454407B2

(12) United States Patent
Takahashi et al.

(10) Patent No.: US 8,454,407 B2
(45) Date of Patent: Jun. 4, 2013

(54) POLISHING METHOD AND APPARATUS

(75) Inventors: Taro Takahashi, Tokyo (JP); Motohiro Niijima, Tokyo (JP); Akihiko Ogawa, Tokyo (JP)

(73) Assignee: Ebara Corporation, Tokyo (JP)

( * ) Notice: Subject to any disclaimer, the term of this patent is extended or adjusted under 35 U.S.C. 154(b) by 911 days.

(21) Appl. No.: 12/511,344

(22) Filed: Jul. 29, 2009

(65) Prior Publication Data

US 2010/0035516 A1 Feb. 11, 2010

(30) Foreign Application Priority Data

Aug. 5, 2008 (JP) ..... 2008-201915
Jul. 16, 2009 (JP) ..... 2009-167788

(51) Int. Cl.
*B24B 49/12* (2006.01)

(52) U.S. Cl.
USPC ..... 451/6; 451/5

(58) Field of Classification Search
USPC ..... 451/41, 37, 63, 5, 6, 8, 9, 287, 288
See application file for complete search history.

(56) References Cited

U.S. PATENT DOCUMENTS 6,358,128 B1 * 3/2002 Sakurai et al. ..... 451/67
6,558,229 B2 * 5/2003 Kimura et al. ..... 451/8
6,634,924 B1 * 10/2003 Ono et al. ..... 451/5
6,929,531 B2 8/2005 Gotkis et al.
7,258,595 B2 8/2007 Tada et al.
2004/0166773 A1 * 8/2004 Tada et al. ..... 451/8

FOREIGN PATENT DOCUMENTS

JP 2004-195629 7/2004
JP 2006-255851 9/2006
JP 2007-311503 11/2007
WO 2008/044786 4/2008

* cited by examiner

*Primary Examiner* — Robert Rose

(74) *Attorney, Agent, or Firm* — Wenderoth, Lind & Ponack, L.L.P.

(57) ABSTRACT

A polishing method polishes and planarizes a substrate. The substrate is pressed against a polishing surface on a rotating polishing table. During polishing, the polishing table is rotated, and the surface, being polished, of the substrate is scanned by an eddy current sensor provided in the polishing table. An output of the eddy current sensor is monitored, and substrate damage is detected from a change in the output of the eddy current sensor. Further, an output of an end point detecting sensor obtained by scanning the surface of the substrate is monitored, and the polishing end point is detected from a change in the output of the end point detecting sensor. After detecting the polishing end point, an output of the end point detecting sensor or another sensor is monitored, and detecting a film left on a part of the substrate is performed.

9 Claims, 27 Drawing Sheets output of eddy current sensor
polishing time
50
100
W
wafer width
table
sensor locus normal wafer
output of eddy current sensor
polishing time
sensor locus
wafer width model 1: edge of wafer is damaged model 2: interior of wafer is damaged model 3: wafer is damaged at porthions near edge model 4:no wafer

POLISHING METHOD AND APPARATUS

BACKGROUND OF THE INVENTION

1. Field of the Invention

The present invention relates to a polishing method and apparatus, and more particularly to a polishing method and apparatus for polishing and planarizing an object to be polished (substrate) such as a semiconductor wafer.

2. Description of the Related Art

In recent years, high integration and high density in semiconductor device demands smaller and smaller wiring patterns or interconnections and also more and more interconnection layers. Multilayer interconnections in smaller circuits result in greater steps which reflect surface irregularities on lower interconnection layers. An increase in the number of interconnection layers makes film coating performance (step coverage) poor over stepped configurations of thin films. Therefore, better multilayer interconnections need to have the improved step coverage and proper surface planarization. Further, since the depth of focus of a photolithographic optical system is smaller with miniaturization of a photolithographic process, a surface of the semiconductor device needs to be planarized such that irregular steps on the surface of the semiconductor device will fall within the depth of focus.

Thus, in a manufacturing process of a semiconductor device, it increasingly becomes important to planarize a surface of the semiconductor device. One of the most important planarizing technologies is chemical mechanical polishing (CMP). In the chemical mechanical polishing, while a polishing liquid containing abrasive particles such as silica ($SiO_2$) therein is supplied onto a polishing surface such as a polishing pad, a substrate such as a semiconductor wafer is brought into sliding contact with the polishing surface and polished using the polishing apparatus.

In forming the above mentioned multilayer interconnections, there has been performed a process in which grooves for interconnections having a predetermined pattern are formed in an insulating layer (dielectric material) on a substrate, the substrate is then dipped in a plating solution to plate the substrate with copper (Cu), for example, by an electroless plating or an electrolytic plating, and then unnecessary portions of a copper layer is selectively removed from the substrate by a CMP process, while leaving only the copper layer in the grooves for interconnections. In this case, if the substrate is insufficiently polished to leave the copper layer on the insulating layer (oxide film), then the circuits would not be separated from each other, but short-circuited. Conversely, if the copper layer in the interconnection grooves is excessively polished away together with the insulating layer, then the resistance of the circuits on the substrate would be so increased that the entirety of the semiconductor substrate might possibly need to be discarded, resulting in a large loss. This holds true for the cases in which other metal films such as aluminum layer are formed, and then polished by the CMP process.

The polishing apparatus which performs the above-mentioned CMP process includes a polishing table having a polishing surface formed by a polishing pad, and a substrate holding device, which is referred to as a top ring or a polishing head, for holding a semiconductor wafer (substrate). When a semiconductor wafer is polished with such a polishing apparatus, the semiconductor wafer is held and pressed against the polishing surface under a predetermined pressure by the substrate holding device. At this time, the polishing table and the substrate holding device are moved relative to each other to bring the semiconductor wafer into sliding contact with the polishing surface, so that the surface of the semiconductor wafer is polished to a flat mirror finish.

Such polishing apparatuses include a type of polishing apparatus which has a pressure chamber formed by an elastic membrane at the lower portion of the substrate holding device and supplies the pressure chamber with a fluid such as air to press the semiconductor wafer against the polishing substrate under a fluid pressure through the elastic membrane, as disclosed in Japanese laid-open patent publication No. 2006-255851, and a type of polishing apparatus which has a holding surface having rigidity formed by ceramics or the like at the lower portion of the substrate holding device and applies a force to the holding surface by an air cylinder or the like to press the semiconductor wafer against the polishing surface.

SUMMARY OF THE INVENTION

In the above-mentioned conventional polishing apparatuses, after the semiconductor wafer is held by the substrate holding device and brought into contact with the polishing surface of the polishing pad, the semiconductor wafer is pressed against the polishing surface under a fluid pressure through the elastic membrane by supplying a pressurized fluid such as compressed air to the pressure chamber or under a force applied to the holding surface by an air cylinder or the like, thereby starting polishing of the semiconductor wafer. However, in some cases, the semiconductor wafer is cracked or damaged during polishing.

Thus, when the semiconductor wafer is cracked or damaged during polishing of the semiconductor wafer, fragments of the broken semiconductor wafer are scattered on the polishing pad. In the case where this polishing pad is reused, a surface of a subsequent semiconductor wafer to be polished will be damaged, and thus the polishing pad must be replaced with a new one every time the semiconductor wafer is cracked or damaged. That is, when the semiconductor wafer is cracked or damaged, maintenance work including replacement work of expendable supplies such as a polishing pad is needed.

In this case, if the semiconductor wafer continues to be polished in its cracked or damaged state, fragments of the broken wafer are scattered around, and thus an area where maintenance work must be done is enlarged. Thus, time for maintenance work and system downtime increase.

On the other hand, the substrate holding apparatus, which is referred to as a top ring or a polishing head, has a retainer ring for holding an outer peripheral edge of the semiconductor wafer, and a lateral force (horizontal force) produced by a frictional force between the semiconductor wafer and the polishing surface of the polishing pad is received by the retainer ring. The retainer ring is vertically movable with respect to the top ring body (or polishing head body), and thus the retainer ring is vertically moved to follow undulation of the polishing surface of the polishing pad and to hold the outer peripheral edge of the semiconductor wafer. However, in some cases, the semiconductor wafer gets over the retainer ring during polishing, and there occurs a phenomenon that the semiconductor wafer jumps (slips) out of the top ring.

The top ring has a slipping-out detecting sensor configured to detect the slipping-out of the semiconductor wafer from the top ring. However, because the semiconductor wafer cannot be detected if the semiconductor wafer which has slipped out of the top ring does not pass through under the slipping-out detecting sensor, the slipping-out of the semiconductor wafer cannot be detected depending on directions of the slipping-out of the semiconductor wafer.

Further, in the above-mentioned conventional polishing apparatus, a metal film on the semiconductor wafer has been removed. After a polishing process is completed, if a subsequent process is carried out in such a state that the metal film is left on the semiconductor wafer, then problems of short circuit or the like occur, and thus the semiconductor wafer cannot be used. Therefore, after the polishing process is completed, the wafer is separated and moved away from the polishing pad (polishing surface), and then an inspection on the presence of the remaining metal film is carried out. In this manner, although it is possible to confirm the remaining film, it takes time for inspection to reduce wafer processing capability. After the inspection, if the remaining film is detected on the wafer, then it is necessary to carry out repolishing. However, in the case where polishing is carried out after the wafer is moved away from the polishing pad, processing time per wafer increases. That is, the throughput is lowered.

The present invention has been made in view of the above circumstances. It is therefore an object of the present invention to provide a polishing method and apparatus which can immediately detect damage of a substrate such as a semiconductor wafer when the substrate is damaged during polishing, and can immediately detect slipping-out of the substrate from the top ring when the substrate slips out of the top ring during polishing.

Further, it is an object of the present invention to provide a polishing method and apparatus which can shorten inspection time by performing an inspection on whether or not there is a remaining film of a metal film (or conductive film) on a substrate such as a semiconductor wafer during polishing, and can shorten processing time by performing additional polishing of the substrate as it is in the case where the remaining film is detected.

In order to achieve the above objects, according to a first aspect of the present invention, there is provided a polishing method of polishing a substrate as an object to be polished by pressing the substrate against a polishing surface on a rotating polishing table, the polishing method comprising: scanning a surface, being polished, of the substrate by an eddy current sensor provided in the polishing table while the polishing table is rotated, during polishing of the substrate; and monitoring an output of the eddy current sensor obtained by scanning the surface, being polished, of the substrate and detecting damage of the substrate from a change in the output of the eddy current sensor.

According to the present invention, while the eddy current sensor passes through under the substrate by rotation of the polishing table, the eddy current sensor outputs a certain voltage value or the like in response to a metal film (or conductive film) of the substrate. The output of the eddy current sensor is monitored, and it is judged that the substrate is damaged in the case where a change in the output value is such a change as to exceed a preset setting range or the like.

In a preferred aspect of the present invention, an effective substrate width is determined from the output of the eddy current sensor in the N-th revolution (N is an integer not less than 1) of the polishing table, a substrate width is determined from the output of the eddy current sensor after the N-th revolution of the polishing table, and when the determined substrate width is narrower than the effective substrate width, it is judged that the damage of the substrate occurs.

According to the present invention, the effective substrate width is calculated from the maximum output value, the minimum output value, and the like of the eddy current sensor in the N-th revolution (N is an integer not less than 1) of the polishing table. In the case where the edge of the substrate is damaged during polishing, because the substrate width calculated from the maximum output value, the minimum output value, and the like of the eddy current sensor becomes small, it is judged whether or not the substrate width has become narrow by comparing the calculated substrate width with the effective substrate width, thereby detecting the damage of the substrate.

In a preferred aspect of the present invention, the output of the eddy current sensor in the N-th revolution (N is an integer not less than 1) of the polishing table is monitored, and the damage of the substrate is detected by comparing output value of the eddy current sensor with a preset threshold value.

In a preferred aspect of the present invention, the number of times the output value of the eddy current sensor is not more than the preset threshold value is counted, and when counter value in a case where the output value is not more than the preset threshold value is within a setting range, it is judged that the damage of the substrate occurs.

According to the present invention, the output value of the eddy current sensor in the N-th revolution (N is an integer not less than 1) of the polishing table is monitored, and it is judged whether or not the output value starts to decrease. In the case where the output value of the eddy current sensor starts to decrease, it is judged whether or not the decreased output value is not more than a preset threshold value. Then, in the case where it is judged that the decrease of the output value of the eddy current sensor is terminated, it is judged whether or not the counter value (Cnt) of cases where the output value is not more than the threshold value is within the setting range. If the counter value is within the setting range, it is judged that the damage of the substrate occurs.

According to a second aspect of the present invention, there is provided a polishing method of polishing a substrate as an object to be polished by holding the substrate and pressing the substrate against a polishing surface on a rotating polishing table by a top ring, the polishing method comprising: scanning a surface, being polished, of the substrate by an eddy current sensor provided in the polishing table while the polishing table is rotated, during polishing of the substrate; and monitoring an output of the eddy current sensor obtained by scanning the surface, being polished, of the substrate and detecting removal of the substrate from the top ring on the basis of a change in the output of the eddy current sensor.

According to the present invention, in the case where the substrate is held by the top ring at the time of starting polishing, the output of the eddy current sensor is high. However, in the case where the substrate jumps (slips) out of the top ring, the output of the eddy current sensor decreases rapidly. In this manner, by monitoring the decrease of the output value of the eddy current sensor, it is possible to detect the case where the substrate jumps (slips) out of the top ring during polishing.

In a preferred aspect of the present invention, the removal of the substrate from the top ring is detected by comparing output value of the eddy current sensor with a set value.

According to the present invention, it is judged whether or not the output value of the eddy current sensor is lower than the set value. When the output value of the eddy current sensor is lower than the set value, it is judged that the substrate jumps (slips) out of the top ting.

According to a third aspect of the present invention, there is provided a polishing method of polishing a substrate as an object to be polished by pressing the substrate against a polishing surface on a rotating polishing table, the polishing method comprising: scanning a surface, being polished, of the substrate by an eddy current sensor provided in the polishing table while the polishing table is rotated, during polishing of the substrate; and monitoring an output of the eddy current sensor obtained by scanning the surface, being polished, of the substrate and detecting damage of the substrate by comparing the output of the eddy current sensor with an output of the eddy current sensor in the case of a normal substrate.

According to the present invention, the output of the eddy current sensor at the time when the eddy current sensor scans the surface (surface to be polished) of the substrate is monitored, and the output of the eddy current sensor is compared with output of the eddy current sensor obtained from the normal substrate. As a result, damage of the substrate can be detected. The output of the eddy current sensor in the case of normal substrate may be obtained from the normal substrate in advance before polishing of the substrate as an object to be polished.

In a preferred aspect of the present invention, the substrate is held and rotated by a top ring, and a rotational speed of the top ring and a rotational speed of the polishing table are set such that loci of scanning the surface, being polished, of the substrate by the eddy current sensor within a predetermined time are distributed substantially evenly over an entire circumference of the surface, being polished, of the substrate.

In a preferred aspect of the present invention, the rotational speed of the top ring and the rotational speed of the polishing table are set such that the loci of scanning the surface, being polished, of the substrate by the eddy current sensor within the predetermined time rotates about 0.5×N times (N is a natural number) on the surface, being polished, of the substrate.

According to a fourth aspect of the present invention, there is provided a polishing apparatus, having a polishing table with a polishing surface and a top ring for holding a substrate as an object to be polished, for polishing the substrate by pressing the substrate against the polishing surface on the rotating polishing table, the polishing apparatus comprising: an eddy current sensor provided in the polishing table for scanning a surface, being polished, of the substrate while the polishing table is rotated; and a controller for monitoring an output of the eddy current sensor obtained by scanning the surface, being polished, of the substrate and detecting damage of the substrate from a change in the output of the eddy current sensor.

In a preferred aspect of the present invention, the controller determines an effective substrate width from the output of the eddy current sensor in the N-th revolution (N is an integer not less than 1) of the polishing table, determines a substrate width from the output of the eddy current sensor after the N-th revolution of the polishing table, and judges that when the determined substrate width is narrower than the effective substrate width, the damage of the substrate occurs.

In a preferred aspect of the present invention, the controller monitors the output of the eddy current sensor in the N-th revolution (N is an integer not less than 1) of the polishing table, and detects the damage of the substrate by comparing output value of the eddy current sensor with a preset threshold value.

In a preferred aspect of the present invention, the controller counts the number of times the output value of the eddy current sensor is not more than the preset threshold value, and judges that the damage of the substrate occurs when counter value in a case where the output value is not more than the preset threshold value is within a setting range.

According to a fifth aspect of the present invention, there is provided a polishing apparatus, having a polishing table with a polishing surface and a top ring for holding a substrate as an object to be polished, for polishing the substrate by pressing the substrate against the polishing surface on the rotating polishing table, the polishing apparatus comprising: an eddy current sensor provided in the polishing table for scanning a surface, being polished, of the substrate while the polishing table is rotated; and a controller for monitoring an output of the eddy current sensor obtained by scanning the surface, being polished, of the substrate and detecting the removal of the substrate from said top ring from a change in the output of the eddy current sensor.

In a preferred aspect of the present invention, the removal of the substrate from the top ring is detected by comparing output value of the eddy current sensor with a set value.

According to a sixth aspect of the present invention, there is provided a polishing apparatus, having a polishing table with a polishing surface and a top ring for holding a substrate as an object to be polished, for polishing the substrate by pressing the substrate against the polishing surface on the rotating polishing table, the polishing apparatus comprising: an eddy current sensor provided in the polishing table for scanning a surface, being polished, of the substrate while the polishing table is rotated; and a controller for monitoring an output of the eddy current sensor obtained by scanning the surface, being polished, of the substrate and detecting damage of the substrate by comparing said output of said eddy current sensor with an output of said eddy current sensor in the case of a normal substrate.

In a preferred aspect of the present invention, the substrate is held and rotated by a top ring, and a rotational speed of the top ring and a rotational speed of the polishing table are set such that loci of scanning the surface, being polished, of the substrate by the eddy current sensor within a predetermined time are distributed substantially evenly over an entire circumference of the surface, being polished, of the substrate.

In a preferred aspect of the present invention, the rotational speed of the top ring and the rotational speed of the polishing table are set such that the loci of scanning the surface, being polished, of the substrate by the eddy current sensor within the predetermined time rotates about 0.5×N times (N is a natural number) on the surface, being polished, of the substrate.

According to a seventh aspect of the present invention, there is provided a polishing method of polishing a film on a substrate as an object to be polished by pressing the substrate against a polishing surface on a rotating polishing table, the polishing method comprising: scanning a surface, being polished, of the substrate by an end point detecting sensor provided in the polishing table while the polishing table is rotated, during polishing of the substrate; monitoring an output of the end point detecting sensor obtained by scanning the surface, being polished, of the substrate; detecting the polishing end point from a change in the output of the end point detecting sensor; and monitoring an output of the end point detecting sensor or a different sensor after detecting the polishing end point and performing monitoring of the remaining film for detecting a film left on a part of the substrate.

According to the present invention, while the end point detecting sensor passes through under the substrate by rotation of the polishing table, the end point detecting sensor outputs a certain voltage value or the like in response to a metal film (or conductive film) of the substrate. The output of the end point detecting sensor is monitored, and the polishing end point is detected when a change in the output reaches the preset film clearing level. Then, after detecting the polishing endpoint, by monitoring the output of the end point detecting sensor or a different sensor and performing monitoring of the remaining film for detecting a film left on a part of the substrate, the inspection on the presence of the remaining film can be performed during polishing.

In a preferred aspect of the present invention, the monitoring of the remaining film is performed by switching sensitivity of the end point detecting sensor.

According to the present invention, in the case where only the endpoint detecting sensor having a certain sensitivity is used from the start of polishing until detection of the polishing end point and monitoring of the remaining film, it is difficult to detect the film if the target film becomes thin or an area of the target film becomes small. On the other hand, in the case where detection of the polishing end point is performed using only a sensor for thin film, if an initial film is thick, outputs become over-range (out of measurement range), and thus the polishing process cannot be monitored. Thus, in the present invention, the sensor sensitivity of the end point detecting sensor is capable of switching in two stages of high sensitivity and low sensitivity, and the low sensor sensitivity may be used from the start of polishing until detection of the polishing endpoint in order to prevent the outputs from becoming over-range (out of measurement range) and the high sensor sensitivity may be used after the detection of the polishing end point, thereby enabling detection of the remaining film on the substrate reliably.

In a preferred aspect of the present invention, the end point detecting sensor comprises an eddy current sensor.

In a preferred aspect of the present invention, the monitoring of the remaining film is performed by a different sensor from the end point detecting sensor.

According to the present invention, in the case where only the end point detecting sensor having a certain sensitivity is used from the start of polishing until detection of the polishing end point and monitoring of the remaining film, it is difficult to detect the film if the target film becomes thin or an area of the target film becomes small. On the other hand, in the case where detection of the polishing end point is performed using only a sensor for thin film, if an initial film is thick, outputs become over-range (out of measurement range), and thus the polishing process cannot be monitored. Thus, in the present invention, the two sensors having different sensitivity are used, and outputs are monitored from the start of polishing until the end point detecting sensor has no sensitivity, thereby detecting the polishing end point. After detection of the end point is performed, the sensor is switched from the end point detecting sensor to the different sensor, thereby enabling detection of the remaining film on the substrate reliably.

Further, in the present invention, two sensors whose types are different from each other may be used. For example, from the start of polishing until detection of the polishing end point, a sensor which is capable of detecting a film even if the film is thick, for example, an eddy current sensor may be used, and after detection of the polishing end point, a sensor for a thin film, for example, an optical sensor, may be used, thereby performing an inspection on whether or not there is a remaining film on the substrate.

In a preferred aspect of the present invention, the end point detecting sensor and the different sensor comprise eddy current sensors which have different sensitivity from each other.

In a preferred aspect of the present invention, the end point detecting sensor comprises an eddy current sensor and the different sensor comprises an optical sensor.

In a preferred aspect of the present invention, the monitoring of the remaining film is performed by monitoring output values at respective measuring points on the locus described when the end point detecting sensor or the different sensor scans the surface, being polished, of the substrate.

According to the present invention, in the case of monitoring of the remaining film after detection of the polishing end point, every time the sensor scans the surface of the substrate one time, the sensor generates output values measured at respective measuring points. Thus, in the case where there is a remaining film, the sensor generates an output having a certain magnitude at the location of the remaining film, and hence it is possible to detect the remaining film having a local small area. Further, it is possible to grasp the location where there is a remaining film from the form or the like of the output of the sensor.

In a preferred aspect of the present invention, when it is confirmed that there is a remaining film by monitoring of the remaining film, this information is transmitted to the controller.

In a preferred aspect of the present invention, when it is confirmed that there is a remaining film by monitoring of the remaining film, additional polishing is performed.

According to the present invention, an inspection on whether or not there is a remaining film on the substrate is performed during polishing, and in the case where the remaining film is detected, additional polishing is performed as it is, and thus processing time can be shortened.

In a preferred aspect of the present invention, when it is confirmed that there is a remaining film by monitoring of the remaining film, a notice of polishing profile abnormality is given to the controller.

According to the present invention, in the case where the remaining film is detected in the remaining film monitoring, the additional polishing is usually performed to remove the thin film. However, in some case, the CMP process has some trouble even if planarization of the wafer is kept by the additional polishing, and hence a notice of the polishing profile abnormality can be given to the controller of the polishing apparatus.

In a preferred aspect of the present invention, during monitoring of the remaining film, supply of the polishing liquid to the polishing surface is stopped, and water is supplied to the polishing surface.

In a preferred aspect of the present invention, when it is confirmed that there is a remaining film by monitoring of the remaining film, additional polishing is performed while water is supplied.

According to an eighth aspect of the present invention, there is provided a polishing apparatus, having a polishing table with a polishing surface and a top ring for holding a substrate as an object to be polished, for polishing a film on the substrate by pressing the substrate against the polishing surface on the rotating polishing table, the polishing apparatus comprising: an end point detecting sensor provided in the polishing table for scanning a surface, being polished, of the substrate while the polishing table is rotated; a controller for monitoring an output of the end point detecting sensor obtained by scanning the surface, being polished, of the substrate and detecting the polishing end point of the substrate from a change in the output of the end point detecting sensor, and performing monitoring of the remaining film for detecting a film left on a part of the substrate by monitoring an output of the end point detecting sensor or a different sensor after detecting the polishing end point.

According to the present invention, while the end point detecting sensor passes through under the substrate by rotation of the polishing table, the end point detecting sensor outputs a certain voltage value or the like in response to a metal film (or conductive film) of the substrate. The output of the end point detecting sensor is monitored, and the polishing end point is detected when a change in the output reaches the preset film clearing level. Then, after detecting the polishing endpoint, by monitoring the output of the end point detecting sensor or a different sensor and performing monitoring of the remaining film for detecting a film left on a part of the substrate, the inspection on the presence of the remaining film can be performed during polishing.

In a preferred aspect of the present invention, the monitoring of the remaining film is performed by switching sensitivity of the end point detecting sensor.

In a preferred aspect of the present invention, the end point detecting sensor comprises an eddy current sensor.

In a preferred aspect of the present invention, the monitoring of the remaining film is performed by a different sensor from the end point detecting sensor.

In a preferred aspect of the present invention, the end point detecting sensor and the different sensor comprise eddy current sensors which have different sensitivity from each other.

In a preferred aspect of the present invention, the end point detecting sensor comprises an eddy current sensor and the different sensor comprises an optical sensor.

In a preferred aspect of the present invention, the monitoring of the remaining film is performed by monitoring output values at respective measuring points on the locus described when the end point detecting sensor or the different sensor scans the surface, being polished, of the substrate.

In a preferred aspect of the present invention, when it is confirmed that there is a remaining film by monitoring of the remaining film, this information is transmitted to the controller.

In a preferred aspect of the present invention, when it is confirmed that there is a remaining film by monitoring of the remaining film, additional polishing is performed.

In a preferred aspect of the present invention, when it is confirmed that there is a remaining film by monitoring of the remaining film, a notice of polishing profile abnormality is given to the controller.

In a preferred aspect of the present invention, during monitoring of the remaining film, supply of the polishing liquid to the polishing surface is stopped, and water is supplied to the polishing surface.

In a preferred aspect of the present invention, when it is confirmed that there is a remaining film by monitoring of the remaining film, additional polishing is performed while water is supplied.

According to the present invention, by scanning the surface of the substrate by the eddy current sensor provided in the polishing table and by monitoring the output of the eddy current sensor, if the substrate is damaged during polishing, it is possible to immediately detect damage of the substrate.

Further, according to the present invention, by scanning the surface of the substrate by the eddy current sensor provided in the polishing table and by monitoring the output of the eddy current sensor, it is possible to immediately detect jumping-out of the substrate from the top ring in the case where the substrate jumps (slips) out of the top ring during polishing.

Further, the present invention has the following effects:

(1) By performing an inspection on whether or not there is a remaining film such as a metal film (or conductive film) on a substrate such as a semiconductor wafer during polishing, inspection time can be shortened and substrate processing capability can be improved.

(2) In the case where the remaining film is detected by performing an inspection on whether or not there is a remaining film such as a metal film (or conductive film) on a substrate during polishing, additional polishing is performed as it is, and thus processing time can be shortened.

(3) In the case where the remaining film is detected by performing an inspection during polishing, because the controller for controlling the entire CMP process controls additional polishing time or the remaining film condition, it is possible to change the polishing condition of the subsequent object to be polished to the optimum condition.

(4) It is possible to perform an inspection on whether or not there is a remaining film such as a metal film (or conductive film) on a substrate such as a semiconductor wafer without separating the substrate from the polishing surface (polishing pad).

DETAILED DESCRIPTION OF THE PREFERRED EMBODIMENTS

Figure 1:
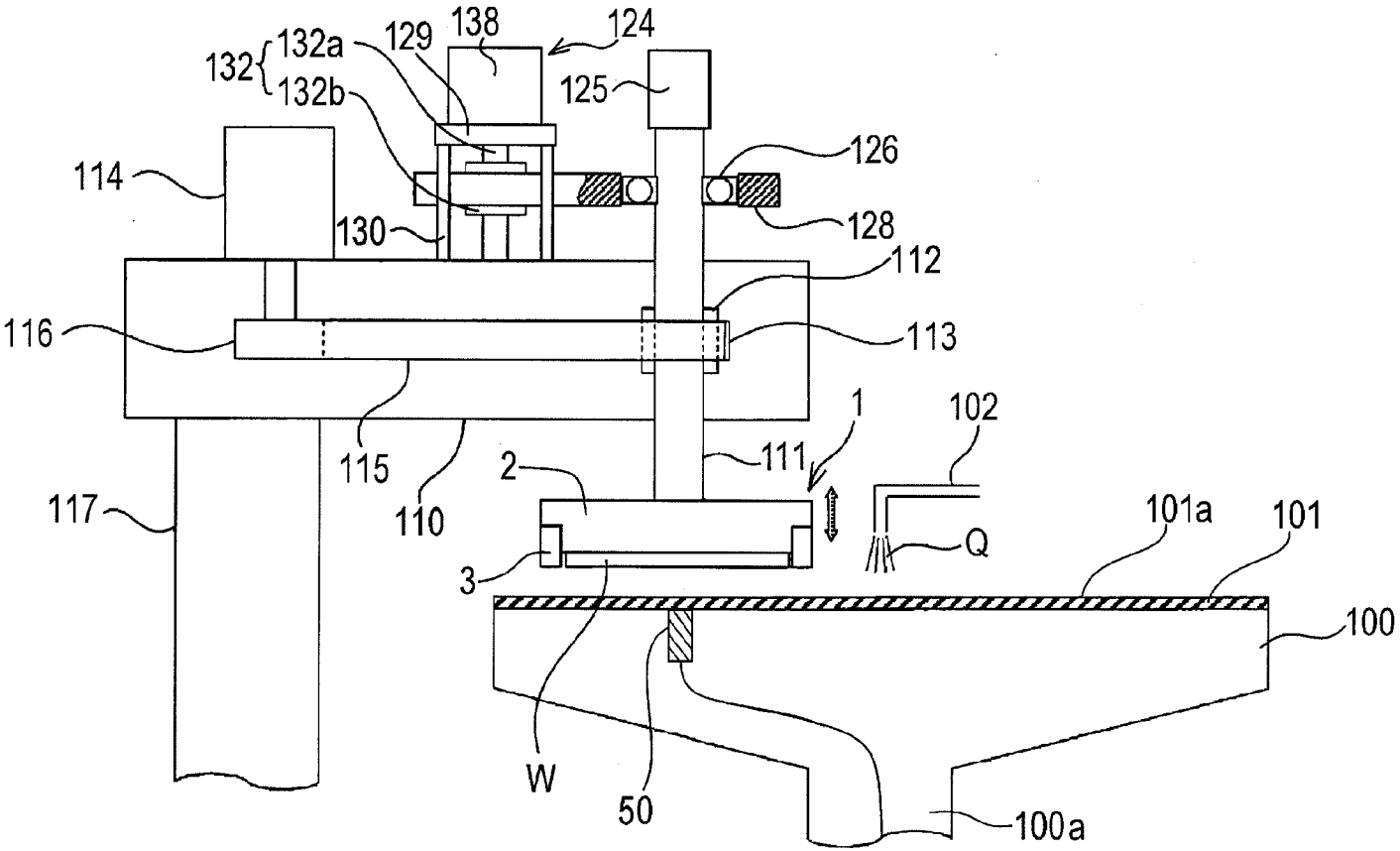
FIG. 1 is a schematic view showing an entire structure of a polishing apparatus according to the present invention.

A polishing apparatus according to embodiments of the present invention will be described below with reference to FIGS. 1 through 27. Like or corresponding structural elements are denoted by like or corresponding reference numerals in FIGS. 1 through 27 and will not be described below repetitively.

FIG. 1 is a schematic view showing an entire structure of a polishing apparatus according to the present invention. As shown in FIG. 1, the polishing apparatus comprises a polishing table 100, and a top ring 1 for holding a substrate such as a semiconductor wafer as an object to be polished and pressing the substrate against a polishing surface on the polishing table.

The polishing table 100 is coupled via a table shaft 100*a* to a motor (not shown) disposed below the polishing table 100. Thus, the polishing table 100 is rotatable about the table shaft 100*a*. A polishing pad 101 is attached to an upper surface of the polishing table 100. An upper surface 101*a* of the polishing pad 101 constitutes a polishing surface configured to polish a semiconductor wafer W. A polishing liquid supply nozzle 102 is provided above the polishing table 100 to supply a polishing liquid Q onto the polishing pad 101 on the polishing table 100. As shown in FIG. 1, an eddy current sensor 50 is embedded in the polishing table 100.

The top ring 1 basically comprises a top ring body 2 for pressing a semiconductor wafer W against the polishing surface 101*a*, and a retainer ring 3 for holding an outer peripheral edge of the semiconductor wafer W to prevent the semiconductor wafer W from being slipped out of the top ring.

The top ring 1 is connected to a top ring shaft 111, and the top ring shaft 111 is vertically movable with respect to a top ring head 110 by a vertically movable mechanism 124. When the top ring shaft 111 moves vertically, the top ring 1 is lifted and lowered as a whole for positioning with respect to the top ring head 110. A rotary joint 125 is mounted on the upper end of the top ring shaft 111.

The vertical movement mechanism 124, which vertically moves the top ring shaft 111 and the top ring 1, has a bridge 128 supporting the top ring shaft 111 in a manner such that the top ring shaft 111 is rotatable via a bearing 126, a ball screw 132 mounted on the bridge 128, a support stage 129 which is supported by poles 130, and an AC servomotor 138 provided on the support stage 129. The support stage 129, which supports the servomotor 138, is fixed to the top ring head 110 via the poles 130.

The ball screw 132 has a screw shaft 132*a* which is coupled to the servomotor 138, and a nut 132*b* into which the screw shaft 132*a* is threaded. The top ring shaft 111 is configured to be vertically movable together with the bridge 128. Accordingly, when the servomotor 138 is driven, the bridge 128 is vertically moved through the ball screw 132. As a result, the top ring shaft 111 and the top ring 1 are vertically moved.

Further, the top ring shift 111 is connected to a rotary sleeve 112 by a key (not shown). The rotary sleeve 112 has a timing pulley 113 fixedly disposed therearound. A top ring motor 114 is fixed to the top ring head 110. The timing pulley 113 is operatively coupled to a timing pulley 116 provided on the top ring motor 114 by a timing belt 115. Therefore, when the top ring motor 114 is driven, the timing pulley 116, the timing belt 115 and the timing pulley 113 are rotated to rotate the rotary sleeve 112 and the top ring shaft 111 in unison with each other, thus rotating the top ring 1. The top ring head 110 is supported on a top ring head shaft 117 which is rotatably supported by a flame (not shown).

In the polishing apparatus constructed as shown in FIG. 1, the top ring 1 is configured to hold a substrate such as a semiconductor wafer W on its lower surface. The top ring head 110 is pivotable about the top ring shaft 117. Thus, the top ring 1, which holds the semiconductor wafer W on its lower surface, is moved from a position at which the top ring 1 receives the semiconductor wafer W to a position above the polishing table 100 by pivotable movement of the top ring head 110. Then, the top ring 1 is lowered to press the semiconductor wafer W against a surface (polishing surface) 101*a* of the polishing pad 101. At this time, while the top ring 1 and the polishing table 100 are respectively rotated, a polishing liquid is supplied onto the polishing pad 101 from the polishing liquid supply nozzle 102 provided above the polishing table 100. In this manner, the semiconductor wafer W is brought into sliding contact with the polishing surface 101*a* of the polishing pad 101*a*. Thus, a surface of the semiconductor wafer W is polished.

Figure 2:
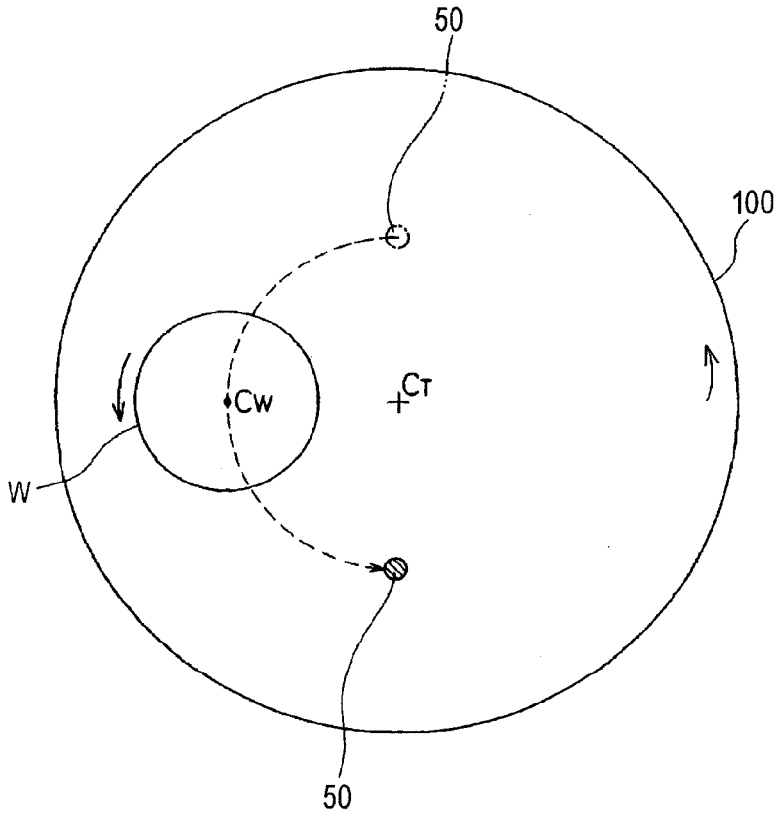
FIG. 2 is a plan view showing the relationship between a polishing table, an eddy current sensor and a semiconductor wafer.

FIG. 2 is a plan view showing the relationship between the polishing table 100, the eddy current sensor 50 and the semiconductor wafer W. As shown in FIG. 2, the eddy current sensor 50 is positioned so as to pass through the center Cw of the semiconductor wafer W held by the top ring 1 during polishing. The symbol CT represents a rotation center of the polishing table 100. For example, while the eddy current sensor 50 passes through under the semiconductor wafer W, the eddy current sensor 50 is capable of detecting a metal film (conductive film) such as a copper layer on the semiconductor wafer W continuously on a passage locus (scanning line).

Next, the eddy current sensor 50 provided on the polishing apparatus according to the present invention will be described in detail with reference to FIGS. 3 through 7.

Figure 3A:
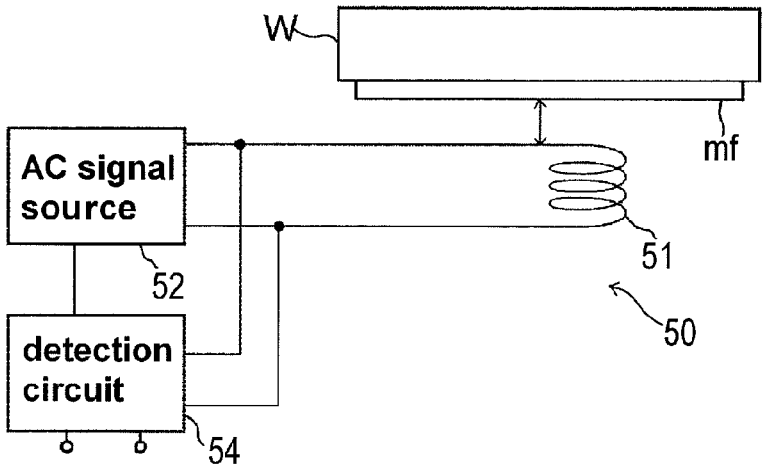
FIG. 3A is a block diagram showing the structure of the eddy current sensor.
Figure 3B:
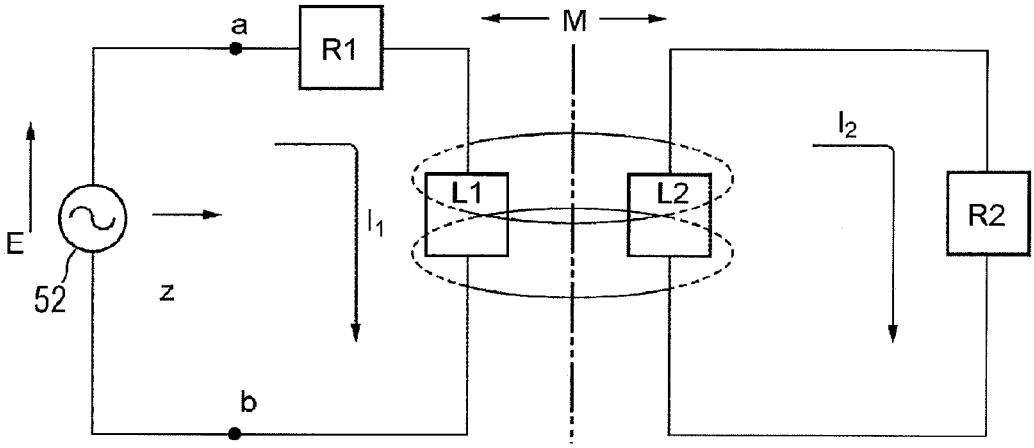
FIG. 3B is an equivalent circuit diagram of the eddy current sensor.

FIGS. 3A and 3B are views showing a structure of the eddy current sensor 50, FIG. 3A is a block diagram showing the structure of the eddy current sensor 50, and FIG. 3B is an equivalent circuit diagram of the eddy current sensor 50.

As shown in FIG. 3A, the eddy current sensor 50 comprises a sensor coil 51 disposed near a metal film (or conductive film) mf as an object to be detected, and an AC signal source 52 connected to the sensor coil 51. The metal film (or conductive film) mf as an object to be detected is, for example, a thin film of Cu, Al, Au, W, or the like formed on the semiconductor wafer W. The sensor coil 51 is a detection coil disposed near the metal film (or conductive film) to be detected, and is spaced from the metal film (or conductive film) by a distance of about 1.0 to 4.0 mm, for example.

Examples of the eddy current sensor include a frequency-type eddy current sensor which detects a metal film (or conductive film) mf based on a change in oscillation frequency that is caused by an eddy current induced in the metal film (or conductive film) mf, and an impedance-type eddy current sensor which detects a metal film (or conductive film) based on a change in impedance. Specifically, in the frequency-type eddy current sensor, as shown in the equivalent circuit of FIG. 3B, when an eddy current $I_2$ is changed, an impedance Z is changed, thus causing a change in the oscillation frequency of the signal source (variable-frequency oscillator) 52. A detection circuit 54 detects the change in the oscillation frequency, thereby detecting a change of the metal film (or conductive film). In the impedance-type eddy current sensor, as shown in the equivalent circuit of FIG. 3B, when the eddy current $I_2$ is changed, the impedance Z is changed. When the impedance Z as viewed from the signal source (variable-frequency oscillator) 52 is changed, the detection circuit 54 detects the change in the impedance Z, thereby detecting a change of the metal film (or conductive film).

In the impedance-type eddy current sensor, signal outputs X and Y, a phase, and a combined impedance Z are derived as describe later. From the frequency F, the impedances X and Y, or the like, it is possible to obtain the measurement information of a metal film (or conductive film) Cu, Al, Au or W. The eddy current sensor 50 is embedded in the polishing table 100 near its surface and faces the semiconductor wafer to be polished through the polishing pad, thereby detecting a change of the metal film (or conductive film) on the semiconductor wafer based on an eddy current flowing through the metal film (or conductive film). The frequency of the eddy current sensor may be obtained from a single radio wave, a mixed radio wave, an AM radio wave, an FM radio wave, a sweep output of a function generator, or a plurality of oscillation frequency sources. It is preferable to select a highly sensitive oscillation frequency and modulation method according to the type of metal film to be measured.

The impedance-type eddy current sensor will be described concretely below. The AC signal sensor 52 comprises an oscillator for generating a fixed frequency in the range of about 2 to 8 MHZz. A crystal quartz oscillator may be used as such an oscillator. When an alternating voltage is supplied from the AC signal source 52 to the sensor coil 51, current $I_1$ flows through the sensor coil 51. When the current flows through the sensor coil 51 disposed near the metal film (or conductive film) mf, a magnetic flux interlinks with the metal film (or conductive film) mf, thus forming a mutual inductance M therebetween to induce an eddy current $I_2$ in the metal film (or conductive film) mf. Here, R1 represents an equivalent resistance at a primary side including the sensor coil, and L1 represents a self-inductance at a primary side also including a sensor coil. In the metal film (or conductive film) mf, R2 represents an equivalent resistance corresponding to the eddy current loss, and L2 represents a self-inductance. The impedance Z as viewed from terminals "a" and "b" of the AC signal source 52 toward the sensor coil is changed depending on the magnitude of the eddy current loss caused in the metal film (or conductive film) mf.

Figure 4:
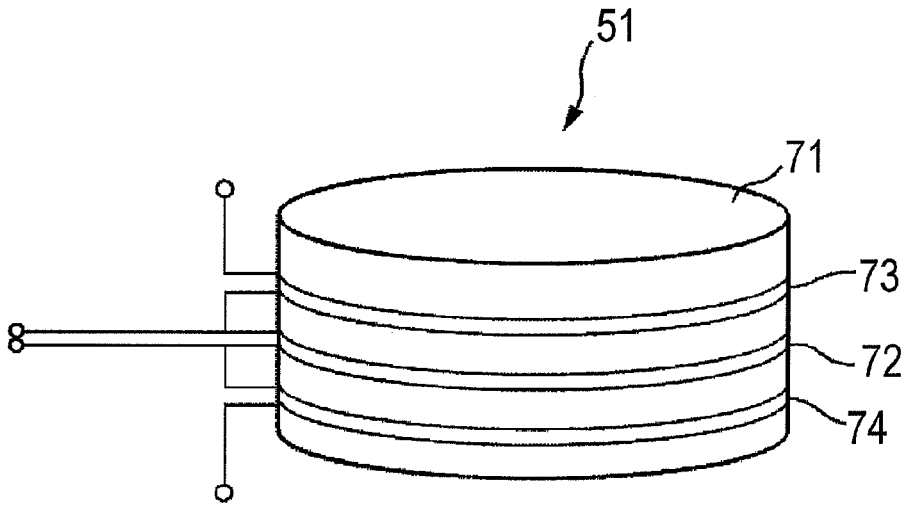
FIG. 4 is a schematic view showing a structural example of a sensor coil in the eddy current sensor according to the present embodiment.

FIG. 4 is a schematic view showing a structural example of the sensor coil in the eddy current sensor according to the present embodiment. As shown in FIG. 4, the sensor coil 51 comprises a coil for generating an eddy current in the metal film (or conductive film), and a coil, separated from the above coil, for detecting the eddy current in the metal film (or conductive film). Specifically, the sensor coil 51 comprises three coils 72, 73 and 74 wound around a bobbin 71. The central coil 72 is an oscillation coil connected to the AC signal source 52. The AC signal source 52 supplies voltage to the oscillation coil 72, and hence the oscillation coil 72 produces a magnetic field to generate an eddy current in the metal film (or conductive film) mf on the semiconductor wafer W disposed near the oscillation coil 72. The detection coil 73 is disposed at an upper side of the bobbin 71 (i.e. at the metal film (or conductive film) side) and detects a magnetic field produced by the eddy current generated in the metal film (or conductive film). The balancing coil 74 is disposed at the opposite side of the detection coil 73 with the respect to the oscillation coil 72.

Figure 5A:
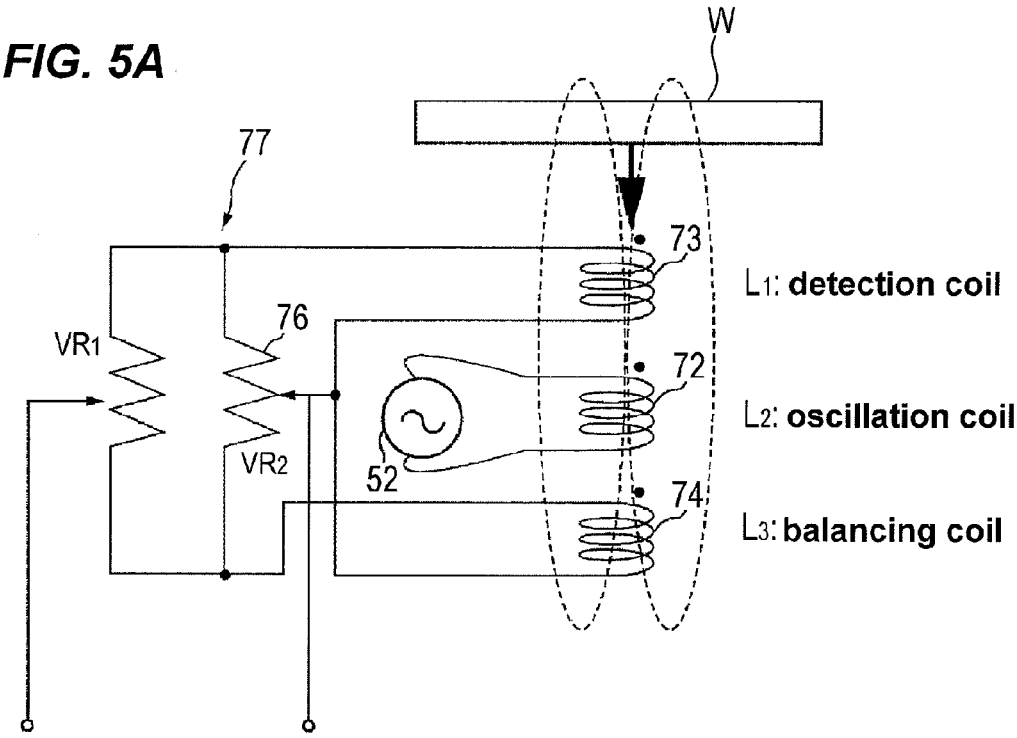
FIGS. 5A, 5B and 5C are schematic views showing a connected configuration of the coils of the sensor coil.
Figure 5B:
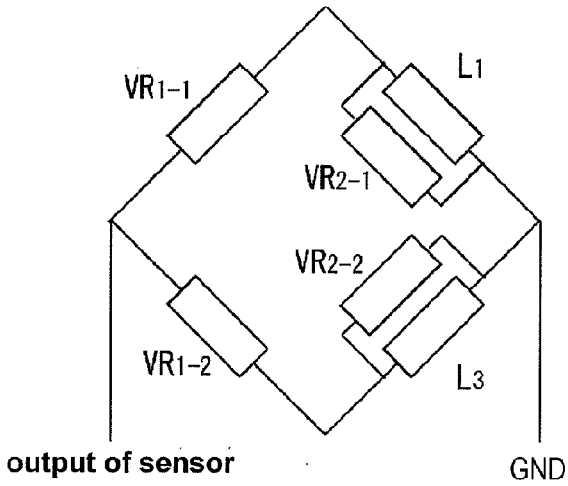
Figure 5C:
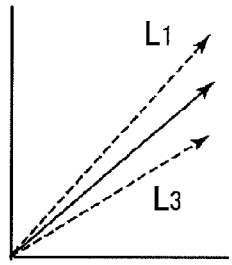

FIGS. 5A, 5B and 5C are schematic views showing a connected configuration of the coils of the sensor coil. As shown in FIG. 5A, the coils 72, 73 and 74 have the same number of turns (1 to 20 turns), and the detection coil 73 and the balancing coil 74 are connected in positive-phase to each other.

The detection coil 73 and the balancing coil 74 constitute a positive-phase series circuit whose terminal ends are connected to a resistance bridge circuit 77 including variable registers 76. The coil 72 is connected to the AC signal source 52, and produces an alternating magnetic flux to generate an eddy current in the metal film (or conductive film) mf that is disposed closely to the coil 72. By adjusting the resistances of the variable resistors 76, an output voltage of the series circuit having the coils 73 and 74 can be adjusted such that the output voltage is zero when no metal film (or conductive film) is present nearby. The variable resistors 76 ($VR_1$, $VR_2$) are connected in parallel to the coils 73 and 74, and are adjusted to keep signals $L_1$ and $L_3$ in phase with each other. Specifically, in the equivalent circuit of FIG. 5B, the variable resistors $VR_1(=VR_{1-1}+VR_{1-2})$, $VR_2(=VR_{2-1}+VR_{2-2})$ are adjusted to satisfy the following equation:

$$VR_{1-1}\times(VR_{2-2}+j\omega L_3)=VR_{1-2}\times(VR_{2-1}+j\omega L_1) \quad (1)$$

In this manner, as shown in FIG. 5C, the signals $L_1$ and $L_3$ (indicated by the dotted lines) are transformed to have the same phase and the same amplitude as each other as indicated by the solid line.

When the metal film (or conductive film) is present near the detection coil 73, the magnetic flux produced by the eddy current generated in the metal film (or conductive film) interlinks with the detection coil 73 and the balancing coil 74. Since the detection coil 73 is positioned closer to the metal film (or conductive film) than the balancing coil 74, induced voltage of the coils 73 and 74 are brought out of balance, thus enabling the detection of the flux linkage produced by the eddy current flowing through the metal film (or conductive film). A zero point can be adjusted by separating the series circuit having the detection coil 73 and the balancing coil 74 from the oscillation coil 72 connected to the AC signal source and adjusting the balance with use of the resistance bridge circuit. Therefore, the eddy current flowing through the metal film (or conductive film) can be detected from the zero point, and thus the eddy current generated in the metal film (or conductive film) can be detected with an increased sensitivity. Therefore, a magnitude of the eddy current flowing through the metal film (or conductive film) can be detected in a wide dynamic range.

Figure 6:
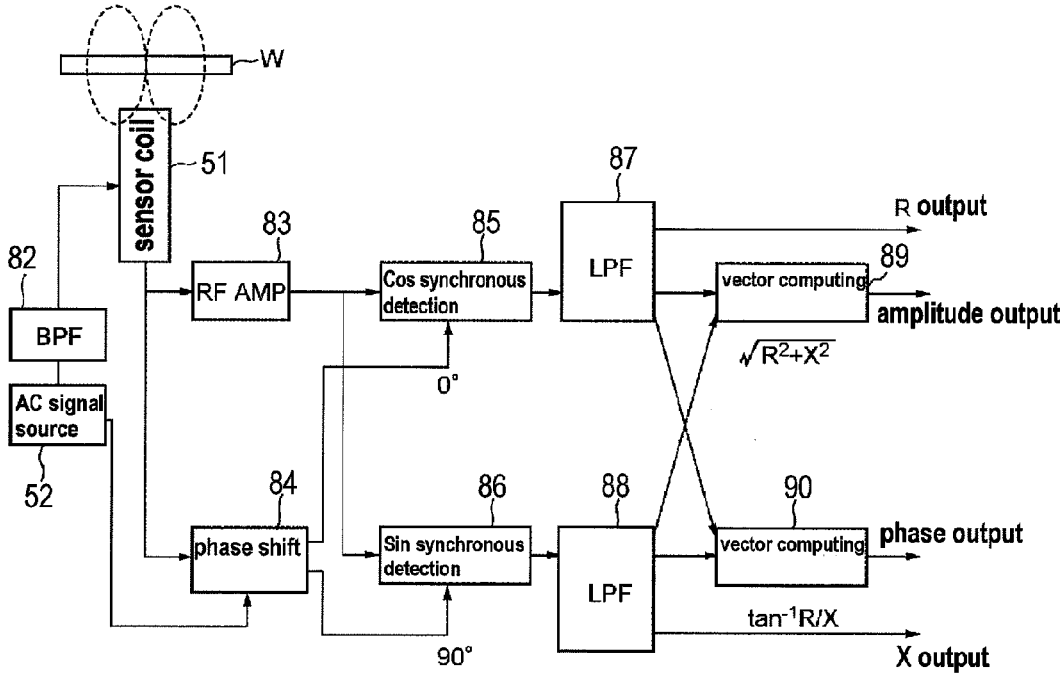
FIG. 6 is a block diagram showing a synchronous detection circuit of the eddy current sensor.

FIG. 6 is a block diagram showing a synchronous detection circuit of the eddy current sensor. FIG. 6 shows an example of a circuit for measuring the impedance Z as viewed from the AC signal source 52 toward the sensor coil 51. The impedance measuring circuit shown in FIG. 6 can extract a resistance component (R), a reactance component (X), an amplitude output (Z), and a phase output ($\tan^{-1}$ R/X), which vary depending on the change in the film thickness.

As described above, the AC signal source 52 supplies an AC signal to the sensor coil 51 disposed closely to the semiconductor wafer W having the metal film (or conductive film) mf to be detected. The AC signal source 52 comprises a fixed-frequency type oscillator such as a crystal quartz oscillator. The AC signal source 52 supplies voltage having a fixed frequency of 2 MHz or 8 MHz, for example. The AC voltage generated by the AC signal source 52 is sent through a band-pass filter 82 to the sensor coil 51. A signal detected at the terminal of the sensor coil 51 is supplied through a high-frequency amplifier 83 and a phase shift circuit 84 to a synchronous detection unit comprising a cos synchronous detection circuit 85 and a sin synchronous detection circuit 86. The synchronous detection unit extracts a cos component and a sin component of the detected signal. The oscillation signal generated by the AC signal source 52 is supplied to the phase shift circuit 84 where the oscillation signal is resolved into two signals, i.e. an in-phase component (0°) and an orthogonal component (90°). These two signals are introduced respectively to the cos synchronous detection circuit 85 and the sin synchronous detection circuit 86, thereby performing the above synchronous detection.

The synchronous detection signals are supplied to low-pass filters 87 and 88 which remove unnecessary high-frequency components from the synchronously detected signals, thereby extracting a resistance component (R) as the cos synchronous detection output and a reactance component (X) as the sin synchronous detection output. A vector computing circuit 89 derives an amplitude $(R^2+X^2)^{1/2}$ from the resistance component (R) and the reactance component (X). Further, a vector computing circuit 90 derives a phase output ($\tan^{-1}$ R/X) from the resistance component (R) and the reactance component (X). Here, the measuring device has various types of filters for removing noise components from the sensor signal. These filters have their respective cutoff frequencies. For example, a low-pass filter has a cutoff frequency in the range of 0.1 to 10 Hz for removing noise components which have been mixed into the sensor signal while the semiconductor wafer is being polished. Thus, the metal film (conductive film) to be measured can be measured with a high accuracy.

Figure 7A:
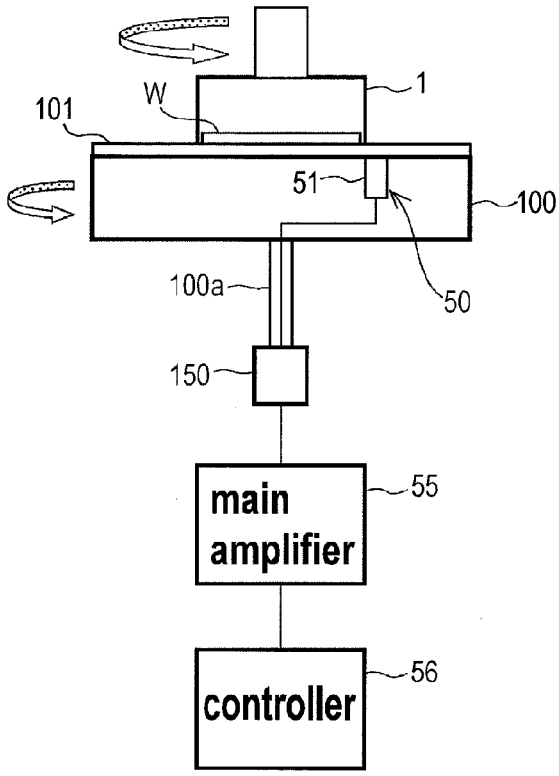
FIG. 7A is a view showing an entire structure of the polishing apparatus including a control unit of the eddy current sensor.
Figure 7B:
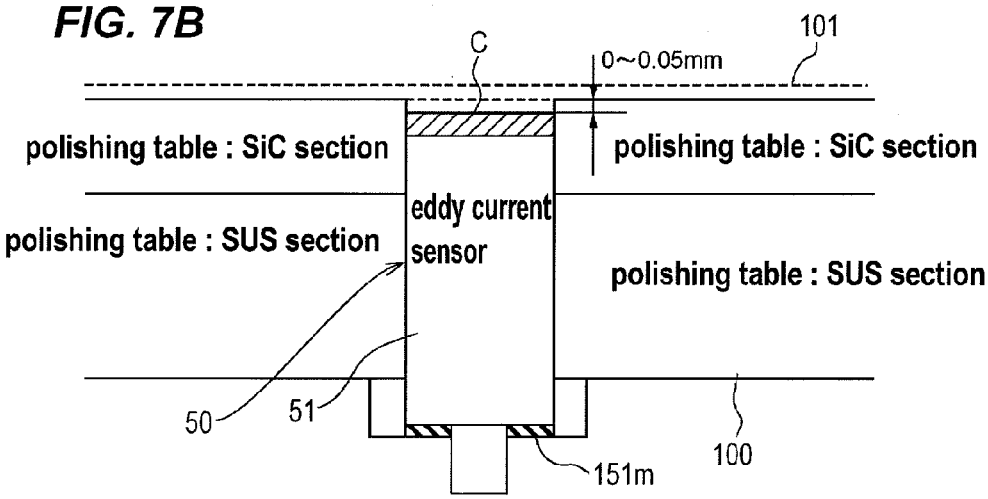
FIG. 7B is an enlarged cross-sectional view of an eddy current sensor section.

FIGS. 7A and 7B are views showing an essential structure of the polishing apparatus having the eddy current sensor. FIG. 7A is a view showing an entire structure of the polishing apparatus including a control unit of the eddy current sensor, and FIG. 7B is an enlarged cross-sectional view of an eddy current sensor section. As shown in FIG. 7A, the polishing table 100 is rotatable about its own axis as indicated by the arrow. The sensor coil 51 having an integrated preamplifier including the AC signal source and the synchronous detection circuit is embedded in the polishing table 100. A connection cable of the sensor coil 51 extends through the table shaft 100*a* and a rotary joint 150 mounted on a shaft end of the table shaft 100*a*, and the sensor coil 51 is connected to a controller 56 through a main amplifier 55 by the connection cable.

The controller 56 has a various type of filters for removing noise components from the sensor signal. These various types of filters have their respective cutoff frequencies. For example, a low-pass filter has a cutoff frequency in the range of 0.1 to 10 Hz to remove noise components which have been mixed into the sensor signal while the semiconductor wafer is being polished. Thus, the metal film (or conductive film) to be measured can be measured with a high accuracy.

As shown in FIG. 7B, a polishing-pad-side end of the eddy current sensor 50 embedded in the polishing table 100 has a coating C made of a fluorine-based raisin such as tetrafluoroethylene for preventing the eddy current sensor from being removed from the polishing table when the polishing pad is removed from the polishing table. The polishing-pad-side end of the eddy current sensor is provided at a position where the upper end of the eddy current sensor is lower than an upper surface (surface facing the polishing pad) of the polishing table made of SiC or the like by a distance ranging from 0 to 0.05 mm, so that the eddy current sensor is prevented from contacting the wafer during polishing. The difference in position between the upper surface of the polishing table and the upper end of the eddy current sensor should be as small as possible. In the actual apparatus, the difference in position is generally set to about 0.02 mm. The position of the eddy current sensor is adjusted by an adjustment mechanism such as a shim (thin plate) 151*n* or a screw.

The rotary joint 150 serves to interconnect the sensor coil 51 and the controller 56. The rotary joint 50 can transmit signals through its rotating section, but has a limitation in the number of signal lines for transmitting the signals. Thus, the signal lines to be connected to the rotary joint are limited to eight signal lines, which are a DC voltage source line, an output signal line, and transmission lines for various types of control signals. The sensor coil 51 has its oscillation frequency switchable from 2 MHz to 8 MHz, and the gain of the preamplifier is also switchable according to the type of film to be polished.

Next, a detecting method for detecting damage (breakage) of the semiconductor wafer and detecting jumping-out (slipping-out) of the semiconductor wafer from the top ring during polishing in the polishing apparatus having the eddy current sensor constructed as shown in FIGS. 1 through 7 will be described in detail.

FIGS. 8A through 8F are schematic views showing the method for detecting damage of the semiconductor wafer and detecting jumping-out (slipping-out) of the semiconductor wafer from the top ring.

Figures 8A, 8B, 8C, 8D, 8E, 8F:
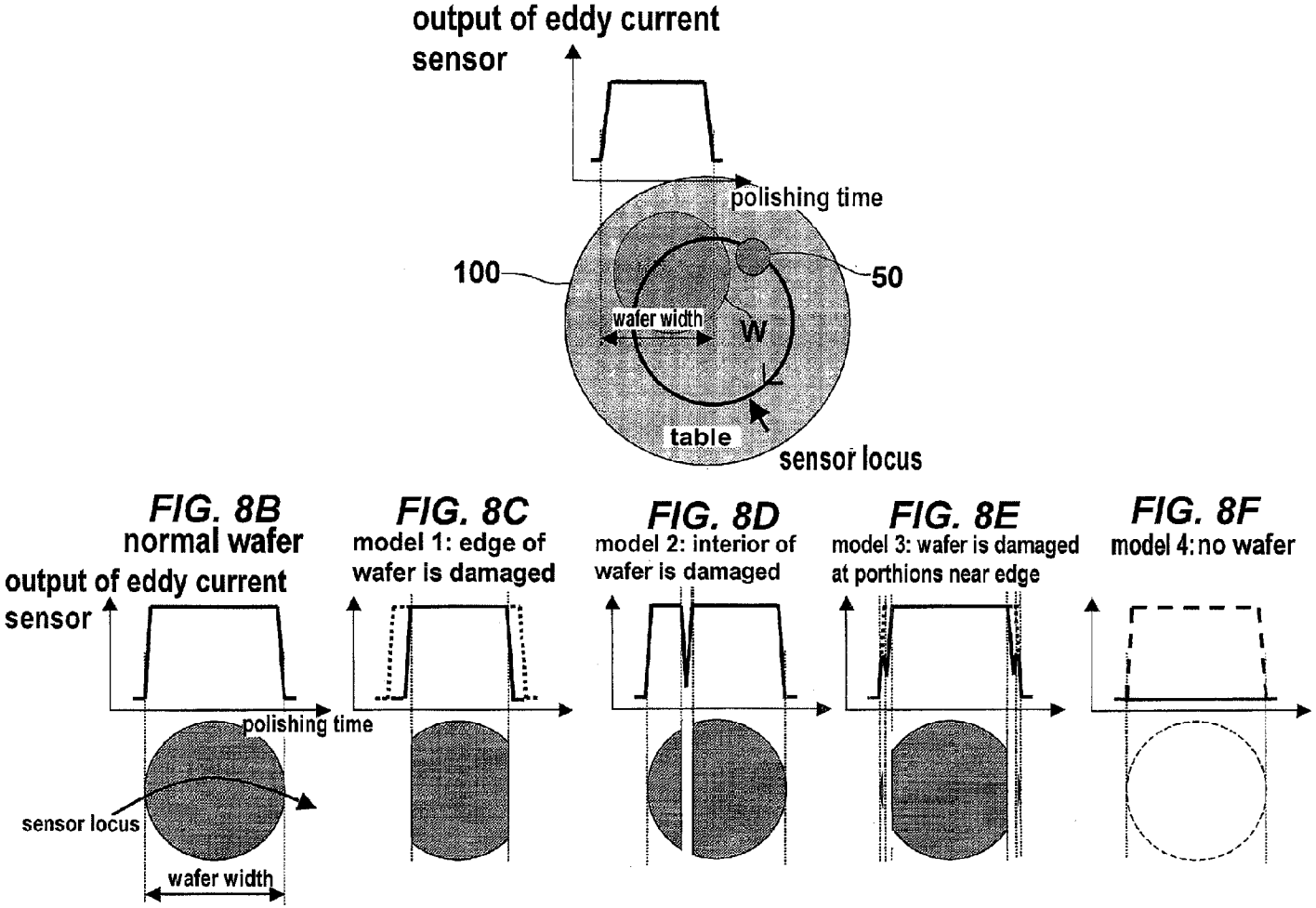
FIGS. 8A through 8F are schematic views showing a method for detecting damage of the semiconductor wafer and detecting jumping-out (slipping-out) of the semiconductor wafer from the top ring.

FIG. 8A shows the relationship between a locus described when the eddy current sensor 50 scans a surface (surface to be polished) of the semiconductor wafer W and an output of the eddy current sensor 50. As shown in FIG. 8A, while the eddy current sensor 50 passes through under the semiconductor wafer W by rotation of the polishing table 100, the eddy current sensor 50 outputs a certain voltage value (V) in response to a metal film (or conductive film) mf of the semiconductor wafer W.

FIGS. 8B through 8F are schematic views showing changes in outputs of the eddy current sensor 50 depending on the state of damage or the like of the semiconductor wafer W. In FIGS. 8B through 8F, the horizontal axis represents polishing time (t), and the vertical axis represents an output value (voltage value) (V) of the eddy current sensor 50.

FIG. 8B is a view showing an output of the eddy current sensor 50 in the case of normal semiconductor wafer W. As shown in FIG. 8B, in the case of normal semiconductor wafer W, the eddy current sensor 50 generates an output (voltage value) in the form of substantially rectangular pulse in response to a metal film (or conductive film) mf on the semiconductor wafer.

FIG. 8C is a view showing an output of the eddy current sensor 50 in the case where an edge of the semiconductor wafer W is damaged. In FIG. 8C, a broken line represents an output in the case of normal semiconductor wafer, and a solid line represents an output in the case where both sides of the edge of the semiconductor wafer are damaged. As shown in FIG. 8C, in the case where the edge of the semiconductor wafer W is damaged (model 1), the eddy current sensor 50 generates an output in the form of substantially rectangular pulse whose both sides chip away compared to the output of the normal semiconductor wafer.

FIG. 8D is a view showing an output of the eddy current sensor 50 in the case where the interior of the semiconductor wafer W is damaged. As shown in FIG. 8D, in the case where the interior of the semiconductor wafer W is damaged (model 2), the eddy current sensor 50 generates an output having a V-shaped lowered part in the damaged part of the semiconductor wafer W.

FIG. 8E is a view showing an output of the eddy current sensor 50 in the case where the semiconductor wafer W is damaged at portions near the edge. As shown in FIG. 8E, in the case where the semiconductor wafer W is damaged at portions near the edge (slightly inner side of the edge) (model 3), the eddy current sensor 50 generates an output having rising parts at the edge of the semiconductor wafer W, V-shaped lowered parts in the damaged parts at slightly inner side of the edge, and normal and substantially rectangular pulse part at further inner side of the damaged parts.

FIG. 8F is a view showing an output of the eddy current sensor 50 in the case where the semiconductor wafer W jumps (slips) out of the top ring. As shown in FIG. 8F, in the case where the semiconductor wafer W is removed from the top ring (model 4), the eddy current sensor 50 generates no output. In FIG. 8F, a broken line represents an output in the case of normal semiconductor wafer, and a solid line represents no output in the case where the semiconductor wafer W jumps (slips) out of the top ring.

As shown in FIGS. 8B through 8F, the outputs of the eddy current sensor 50 at the time when the eddy current sensor 50 scans the surface (surface to be polished) of the semiconductor wafer W are monitored, and the outputs of the eddy current sensor 50 are compared with outputs of the eddy current sensor 50 obtained from the normal semiconductor wafer W. As a result, damage of the semiconductor wafer W and jumping-out (slipping-out) of the semiconductor wafer W from the top ring 1 can be detected.

Figure 9A:
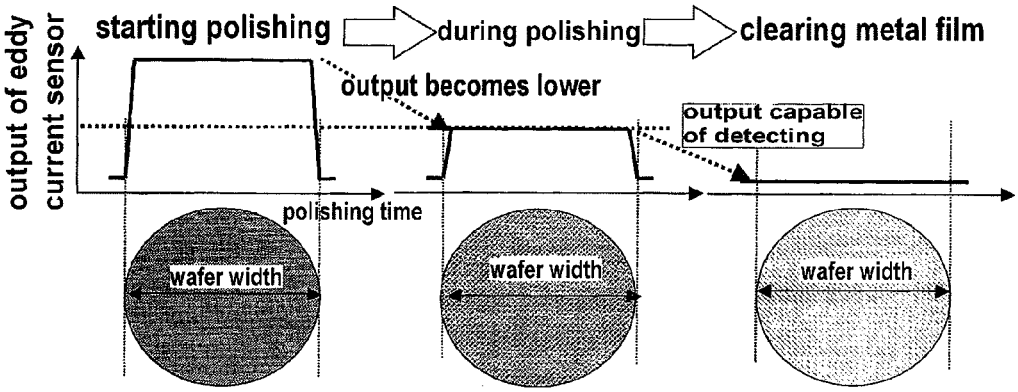
FIG. 9A is a view showing the relationship between a polishing process from starting polishing of the semiconductor wafer to clearing (removing) of a metal film (or conductive film) on the semiconductor wafer, and outputs of the eddy current sensor.

FIG. 9A is a view showing the relationship between a polishing process from starting polishing of the semiconductor wafer W to clearing (removing) of a metal film (or conductive film) mf on the semiconductor wafer W, and outputs of the eddy current sensor 50. As shown in FIG. 9A, an output of the eddy current sensor 50 is high immediately after starting polishing of the semiconductor wafer W, because the metal film (or conductive film) mf is thick. Then, an output of the eddy current sensor 50 becomes lower with progress of polishing, because the metal film (or conductive film) mf becomes thinner. When the metal mf is cleared (removed), the output of the eddy current sensor 50 becomes zero. Therefore, in order to detect damage of the semiconductor wafer W at a high accuracy, it is desirable that detection should be terminated at the time when the metal film mf becomes thin.

Figure 9B:
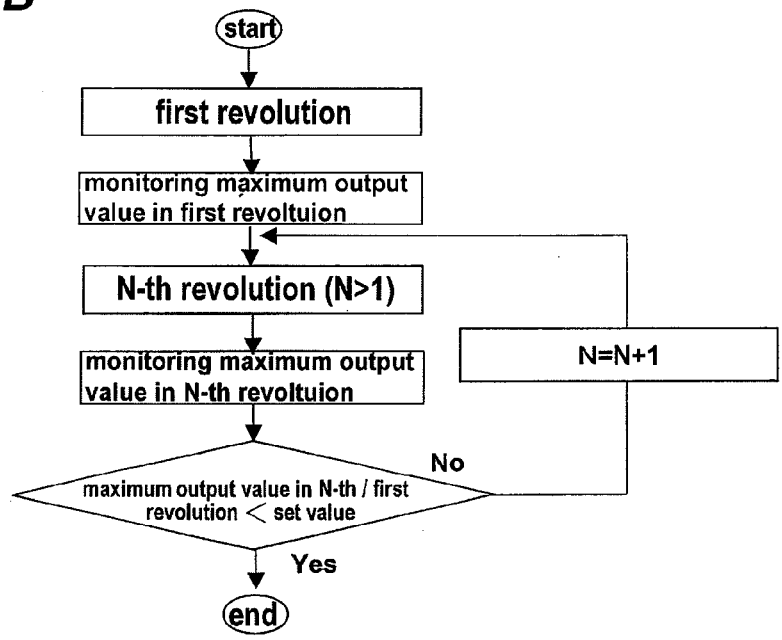
FIG. 9B is a flow chart showing a procedure of a monitoring process for detecting damage of the semiconductor wafer.

FIG. 9B is a flow chart showing a procedure of a monitoring process for detecting damage of the semiconductor wafer W. As shown in FIG. 9B, when the polishing table 100 makes one revolution to allow the eddy current sensor 50 to scan the surface (surface to be polished) of the semiconductor wafer W, the eddy current sensor 50 generates an output in the form of substantially rectangular pulse. The controller 56 (see FIG. 7) monitors the maximum output value of the eddy current sensor 50 during the first revolution of the polishing table 100. The controller 56 subsequently monitors the maximum output value of the eddy current sensor 50 each time the polishing table 100 makes one revolution, and monitors the maximum output value of the eddy current sensor 50 in the N-th revolution of the polishing table 100 (N>1). Then, the controller 56 judges whether or not a value obtained by dividing the maximum output value in the N-th revolution of the polishing table 100 by the maximum output value in the first revolution of the polishing table 100 is smaller than a set value.

Specifically, the controller 56 determines "(the maximum output value in the N-th revolution)/(the maximum output value in the first revolution)<the set value. Then, the controller 56 terminates the monitoring process if this value is smaller than the set value, and continues the monitoring process if this value is larger than the set value and monitors the maximum output value of the eddy current sensor 50 in the subsequent revolution (N=N+1) of the polishing table 100. By carrying out the monitoring process in accordance with the flow chart shown in FIG. 9B, when the metal film mf of the semiconductor wafer W becomes thin, detection of the metal film mf is terminated. Thus, damage of the semiconductor wafer W can be detected with a high accuracy. A terminating method of the monitoring process is applied to the termination of detection in FIG. 10A and termination of detection in FIG. 11A.

The above set value can be set to a desired value within a range of the state in which the metal film remains.

Figure 10A:
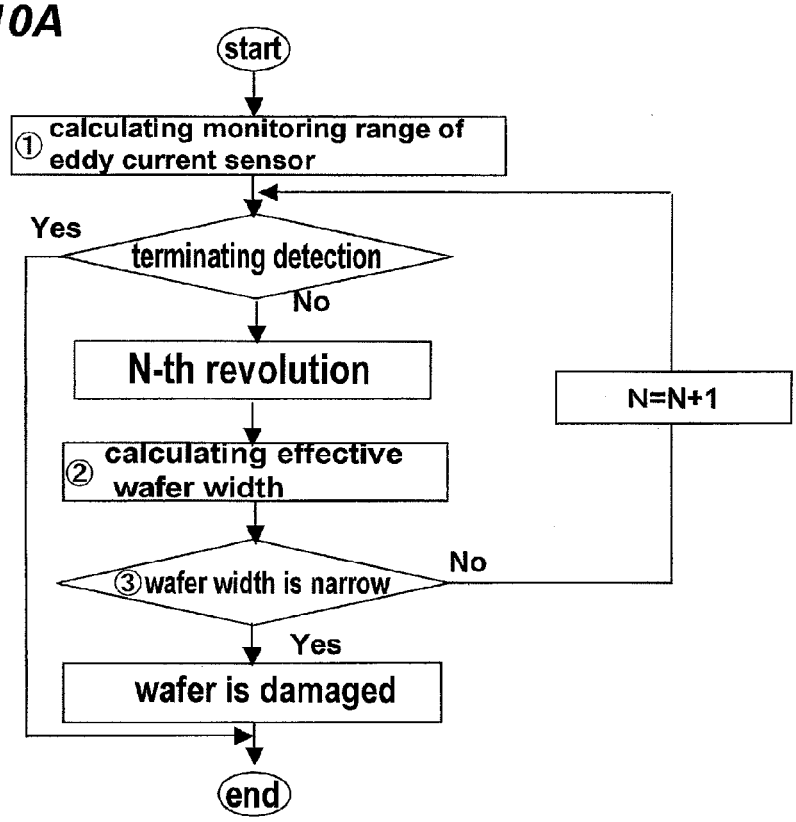
FIG. 10A is a flow chart showing a procedure of the monitoring process for detecting the case where the edge of the semiconductor wafer is damaged during polishing (model 1) and the case where the semiconductor wafer W is damaged at portions near the edge during polishing (model 3)
Figure 10B:
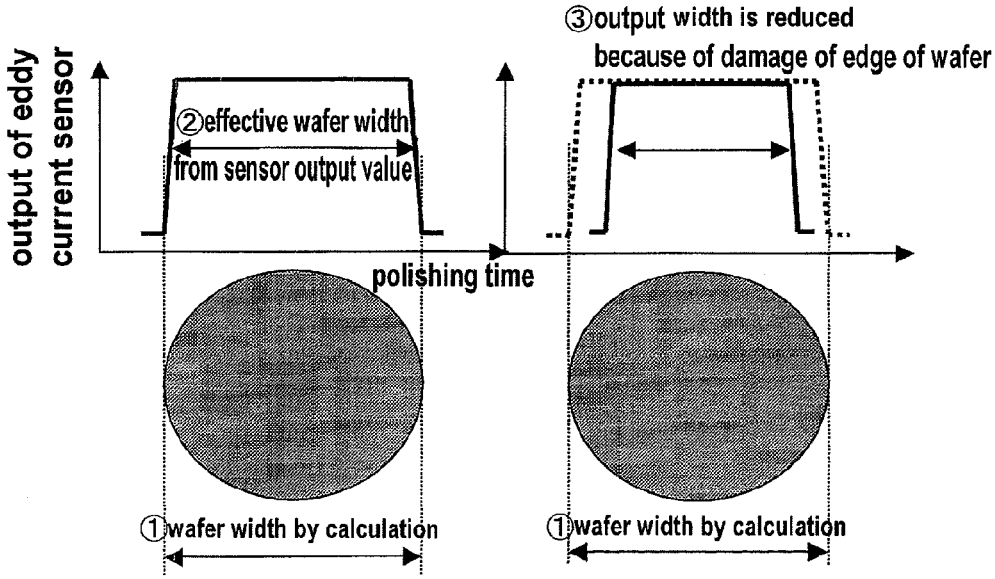
FIG. 10B is a view showing the relationship between the semiconductor wafer and outputs of the eddy current sensor in the monitoring process.

FIG. 10A is a flow chart showing a procedure of the monitoring process for detecting the case where the edge of the semiconductor wafer W is damaged during polishing (model 1) and the case where the semiconductor wafer W is damaged at portions near the edge during polishing (model 3). FIG. 10B is a view showing the relationship between the semiconductor wafer W and outputs of the eddy current sensor 50 in the monitoring process.

As shown in FIG. 10A, the controller 56 (see FIG. 7) calculates a monitoring range of the eddy current sensor 50 from an actual wafer width of the semiconductor wafer W and the number of revolutions (rpm) of the polishing table 100. For example, in the case where sampling in the detection system is carried out at 1 msec, the monitoring range is changed depending on the number of revolutions (rpm) of the polishing table. In the case where the number of revolutions of the polishing table is 60 rpm=1 second/one revolution of table, about 200 msec (=300 mm) becomes the monitoring range. In the case where the number of revolutions of the polishing table is 120 rpm=0.5 second/one revolution of table, about 100 msec (=300 mm) becomes the monitoring range.

Then, the controller 56 (see FIG. 7) calculates an effective wafer width from the maximum output value and the minimum output value of the eddy current sensor 50 in the N-th revolution (N is an integer not less than 1) of the polishing table 100. The left figure of FIG. 10B shows the effective wafer width calculated from the maximum output value and the minimum output value of the eddy current sensor 50.

In the case where the edge of the semiconductor wafer W is damaged during polishing, because the wafer width calculated from the maximum output value and the minimum output value of the eddy current sensor 50 becomes small, the controller 56 judges whether or not the wafer width has become narrow by comparing this calculated wafer width with the effective wafer width, and detects the damage of the wafer. The right figure of FIG. 10B shows the state in which the output width is reduced (wafer width becomes narrower) compared to the effective wafer width (indicated by the broken line) calculated from the maximum output value and the minimum output value of the eddy current sensor 50. The wafer width is important because the monitoring process shown in FIGS. 10A and 10B is the monitoring process for detecting the damage of the edge portion of the wafer. Therefore, the process makes it possible to detect the damage of the edge portion of the wafer reliably by calculating the effective wafer width from the maximum output value and the minimum output value of the eddy current sensor 50 and comparing this effective wafer width with the wafer width calculated from the maximum output value and the minimum output value of the eddy current sensor 50 during polishing. Thus, it is possible to reliably detect the case where the edge of the semiconductor wafer W is damaged during polishing (model 1) and the case where the semiconductor wafer W is damaged at portions near the edge (model 3) by monitoring a change of the wafer width from the output value of the eddy current sensor 50.

Figure 11A:
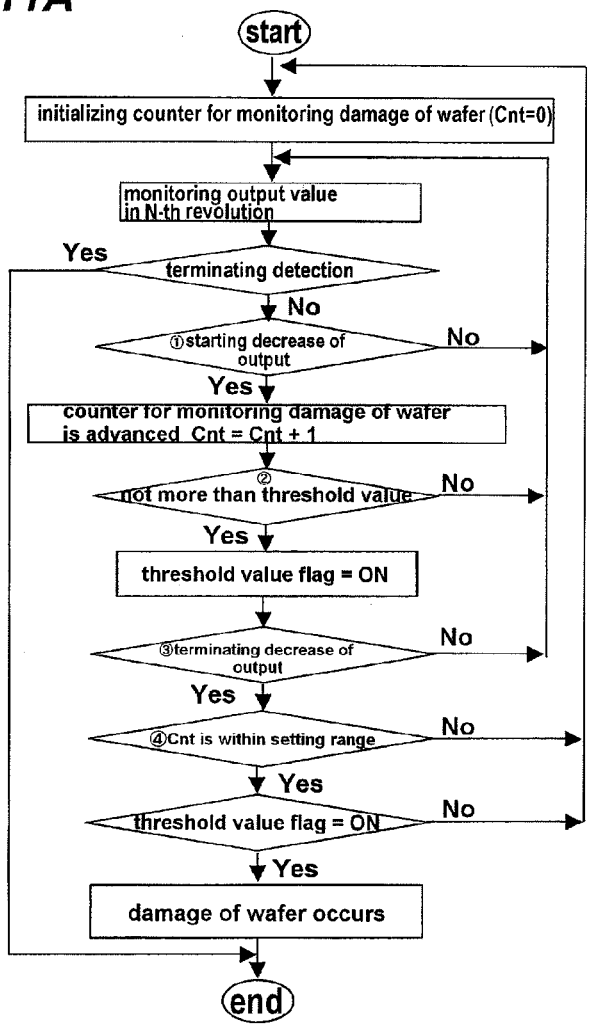
FIG. 11A is a flow chart showing a procedure of a monitoring process for detecting the case where the interior of the semiconductor wafer is damaged during polishing (model 2)
Figure 11B:
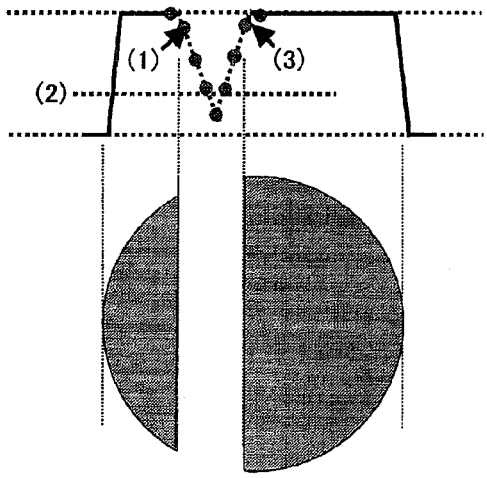
FIG. 11B is a view showing the relationship between the semiconductor wafer and outputs of the eddy current sensor in the monitoring process.

FIG. 11A is a flow chart showing a procedure of a monitoring process for detecting the case where the interior of the semiconductor wafer W is damaged during polishing. FIG. 11B is a view showing the relationship between the semiconductor wafer W and outputs of the eddy current sensor 50 in the monitoring process.

As shown in FIG. 11A, the controller 56 (see FIG. 7) initializes the counter (Cnt=0) for monitoring the damage of the wafer. Then, the controller 56 monitors the output value of the eddy current sensor 50 in the N-th revolution (N is an integer not less than 1) of the polishing table 100 and judges whether or not this output value starts to decrease. As the state shown in (1) of FIG. 11B, in the case where the output value of the eddy current sensor 50 starts to decrease, the counter is advanced by one.

Specifically, Cnt=Cnt+1

Next, the controller 56 judges whether or not the decreased output value is not more than a preset threshold value. In this case, the preset threshold value is, for example, a value determined by multiplying the maximum output value (the maximum voltage value) by the a preset ratio (%) (the threshold value=the maximum voltage value X the preset ratio (%)). As the state shown in (2) of FIG. 11B, in the case where the output value of the eddy current sensor 50 is not more than the preset threshold value, the threshold value flag turns ON (the threshold value flag=ON). This step is continued while the output value of the eddy current sensor 50 is decreasing.

Next, as the state shown in (3) of FIG. 11B, in the case where the controller 56 judges that the output value of the eddy current sensor 50 has decreased, the controller 56 judges whether or not the counter value (Cnt) of cases where the output value is not more than the threshold value is within the setting range. Then, if the counter value is within the setting range, the controller 56 further judges whether or not the threshold value flag is ON (the threshold value flag=ON). If the threshold value flag is ON, the controller 56 judges that the damage of the wafer occurs. In this manner, by monitoring the decrease of the output value of the eddy current sensor 50, it is possible to detect the case where the interior of the semiconductor wafer W is damaged during polishing (model 2).

According to the monitoring process shown in FIGS. 11A and 11B, the controller 56 counts the cases where the output value of the eddy current sensor 50 is not more than the preset threshold value and judges that the semiconductor wafer is damaged in the case where the counter value of the cases where the above output value of the eddy current sensor 50 is not more than the above threshold value is within the setting range, and thus it is possible to prevent erroneous detection of the damage of the semiconductor wafer and to detect the damage of the semiconductor wafer with a high accuracy.

Figure 12A:
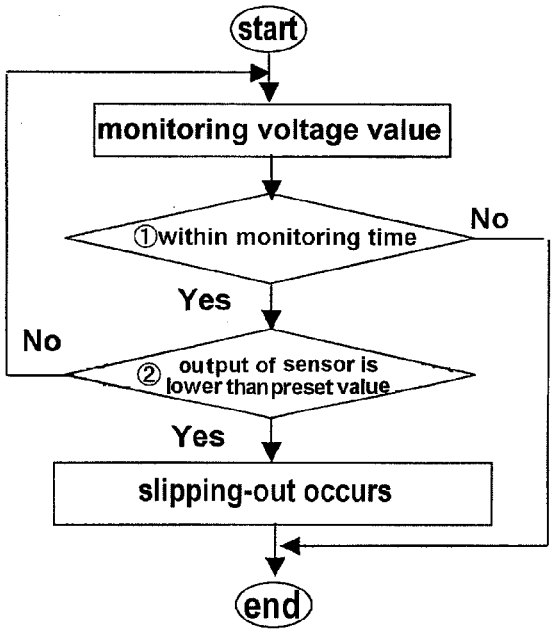
FIG. 12A is a flow chart showing a procedure of a monitoring process for detecting the case where the semiconductor wafer W jumps (slips) out of the top ring during polishing (model 4)
Figure 12B:
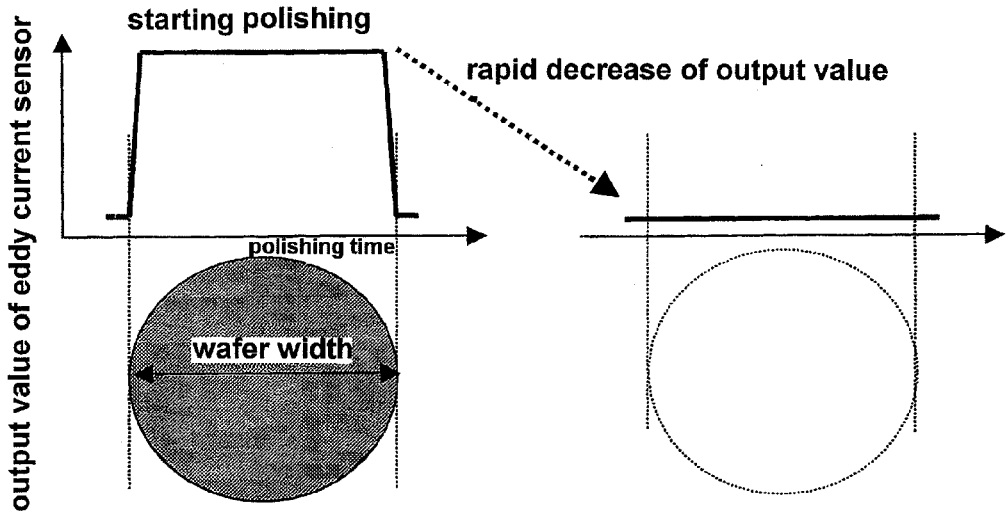
FIG. 12B is a view showing the relationship between the semiconductor wafer W and an output of the eddy current sensor 50 in the monitoring process.

The reason why the threshold value and the setting range of the counter value are provided in order to avoid erroneous detection is to deal with the situation where polishing profile goes wrong. For example, when a metal film remains largely over the entire edge portion of the wafer, the positions (1) and (3) in FIG. 11B correspond to both end portions of the semiconductor wafer. If the difference in height of polishing profile is abnormally large, in some cases, the output value becomes not more than the threshold value of (2) in FIG. 11B. Therefore, in the case of (1) and (3) of FIG. 11B, it is necessary to provide a certain degree of limitation on distance (time) in order to avoid erroneous detection that the semiconductor wafer is damaged when the metal film remains largely over the edge portion of the wafer FIG. 12A is a flow chart showing a procedure of a monitoring process for detecting the case where the semiconductor wafer W jumps (slips) out of the top ring during polishing (model 4). FIG. 12B is a view showing the relationship between the semiconductor wafer W and an output of the eddy current sensor 50 in the monitoring process.

As shown in FIG. 12A, the controller 56 (see FIG. 7) monitors the output value (voltage value) of the eddy current sensor 50. Then, the controller 56 judges whether or not time is within monitoring time for monitoring the output of the eddy current sensor 50, and if it is within the monitoring time, the controller 56 judges whether or not the output value of the eddy current sensor 50 is lower than the set value. When the output value of the eddy current sensor 50 is lower than the set value, the controller 56 judges that the semiconductor wafer W jumps (slips) out of the top ting. As shown in FIG. 12B, in the case where the semiconductor wafer W is held by the top ring at the time of starting polishing, the output value of the eddy current sensor 50 is high. However, in the case where the semiconductor wafer W jumps (slips) out of the top ring, the output of the eddy current sensor 50 decreases rapidly. In this manner, by monitoring the rapid decrease of the output value of the eddy current sensor 50, it is possible to detect the case where the semiconductor wafer W jumps (slips) out of the top ring during polishing (model 4).

Next, a method of detecting and monitoring a metal film (or conductive film) on the semiconductor wafer during polishing in the polishing apparatus having the eddy current sensor constructed as shown in FIGS. 1 through 7 will be described below in detail.

Figure 13B:
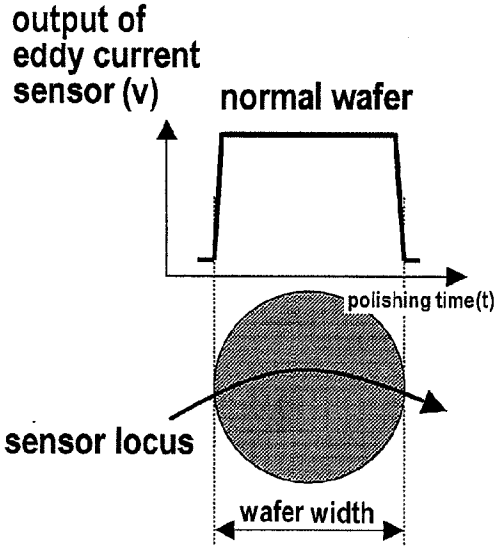
FIG. 13B is a view showing an output of the eddy current sensor in the case of normal semiconductor wafer.
Figure 13A:
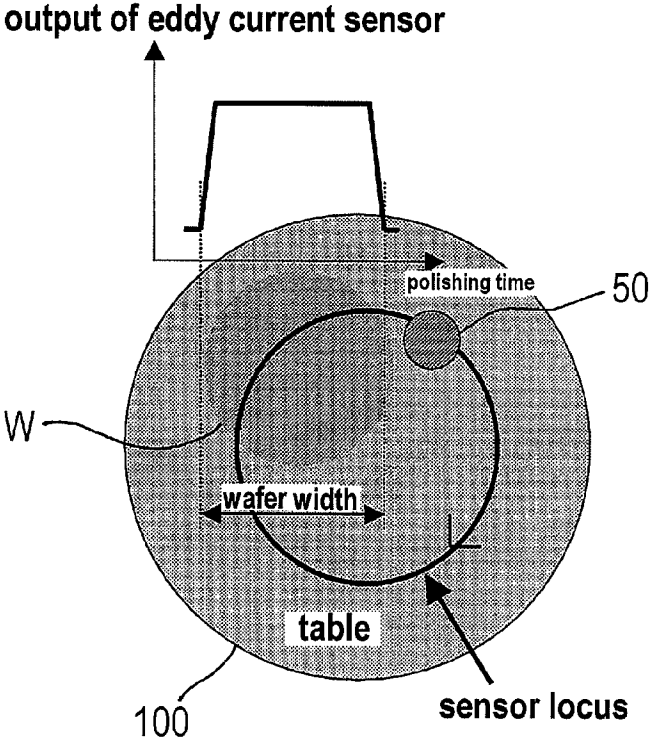
FIG. 13A shows the relationship between a locus described when the eddy current sensor scans a surface (surface to be polished) of the semiconductor wafer and an output of the eddy current sensor.

FIG. 13A shows the relationship between a locus described when the eddy current sensor 50 scans a surface (surface to be polished) of the semiconductor wafer W and an output of the eddy current sensor 50. As shown in FIG. 13A, while the eddy current sensor 50 passes through under the semiconductor wafer W by rotation of the polishing table 100, the eddy current sensor 50 outputs a certain voltage value (V) in response to a metal film (or conductive film) mf of the semiconductor wafer W.

FIG. 13B is a view showing an output of the eddy current sensor 50 in the case of normal semiconductor wafer W. In FIG. 13B, the horizontal axis represents polishing time (t), and the vertical axis represents an output value (voltage value) (V) of the eddy current sensor 50. As shown in FIG. 13B, in the case of the normal semiconductor wafer W, the eddy current sensor 50 generates an output (voltage value) in the form of substantially rectangular pulse in response to a metal film (or conductive film) mf on the semiconductor wafer W.

Figure 14A:
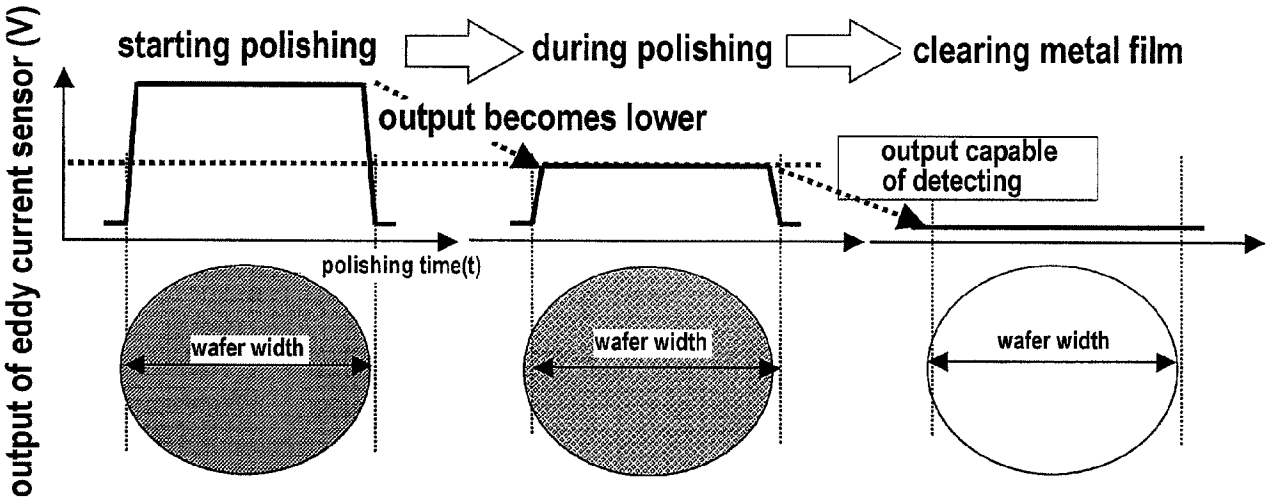
FIG. 14A is a view showing the relationship between a polishing process from starting polishing of the semiconductor wafer to clearing (removing) of a metal film (or conductive film) on the semiconductor wafer and outputs of the eddy current sensor.

FIG. 14A is a view showing the relationship between a polishing process from starting polishing of the semiconductor wafer W to clearing (removing) of a metal film (or conductive film) mf on the semiconductor wafer W and outputs of the eddy current sensor 50. As shown in FIG. 14A, the output of the eddy current sensor 50 is high immediately after starting polishing of the semiconductor wafer W, because the metal film (or conductive film) mf is thick. Then, an output of the eddy current sensor 50 becomes lower with progress of polishing, because the metal film mf becomes thinner. When the metal film mf is cleared (removed), the output value of the eddy current sensor 50 disappears.

Figure 14B:
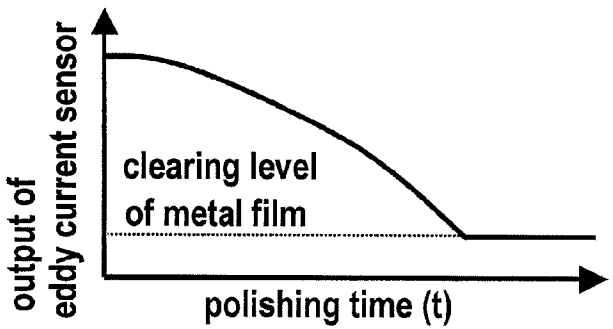
FIG. 14B is a view showing the relationship between the polishing time (t) from starting polishing of the semiconductor wafer W to clearing (removing) of a metal film (or conductive film) mf on the semiconductor wafer W and a change in an output value of the eddy current sensor.

FIG. 14B is a view showing the relationship between the polishing time (t) from starting polishing of the semiconductor wafer W to clearing (removing) of a metal film (or conductive film) mf on the semiconductor wafer W and a change in an output value of the eddy current sensor 50. When the polishing table 100 makes one revolution to allow the eddy current sensor 50 to scan the surface (surface to be polished) of the semiconductor wafer W, the eddy current sensor 50 generates an output in the form of substantially rectangular pulse. Every time the eddy current sensor 50 scans the surface of the semiconductor wafer W one time, the controller 56 (see FIG. 7) outputs an average value as an output value which is obtained by averaging output values at respective measuring points on a passage locus (scanning line). Then, the controller 56 monitors the output value as the average value obtained by averaging the output values at the respective measuring points of the eddy current sensor 50 every time the polishing table makes one revolution, and continues to monitor the output value until the output value of the eddy current sensor 50 disappears.

FIG. 14B shows a change in the output value (average value) of the eddy current sensor 50 with polishing time. As shown in FIG. 14B, by monitoring the output value of the eddy current sensor 50, it is possible to detect the state where the metal film is uniformly cleared.

Figure 15:
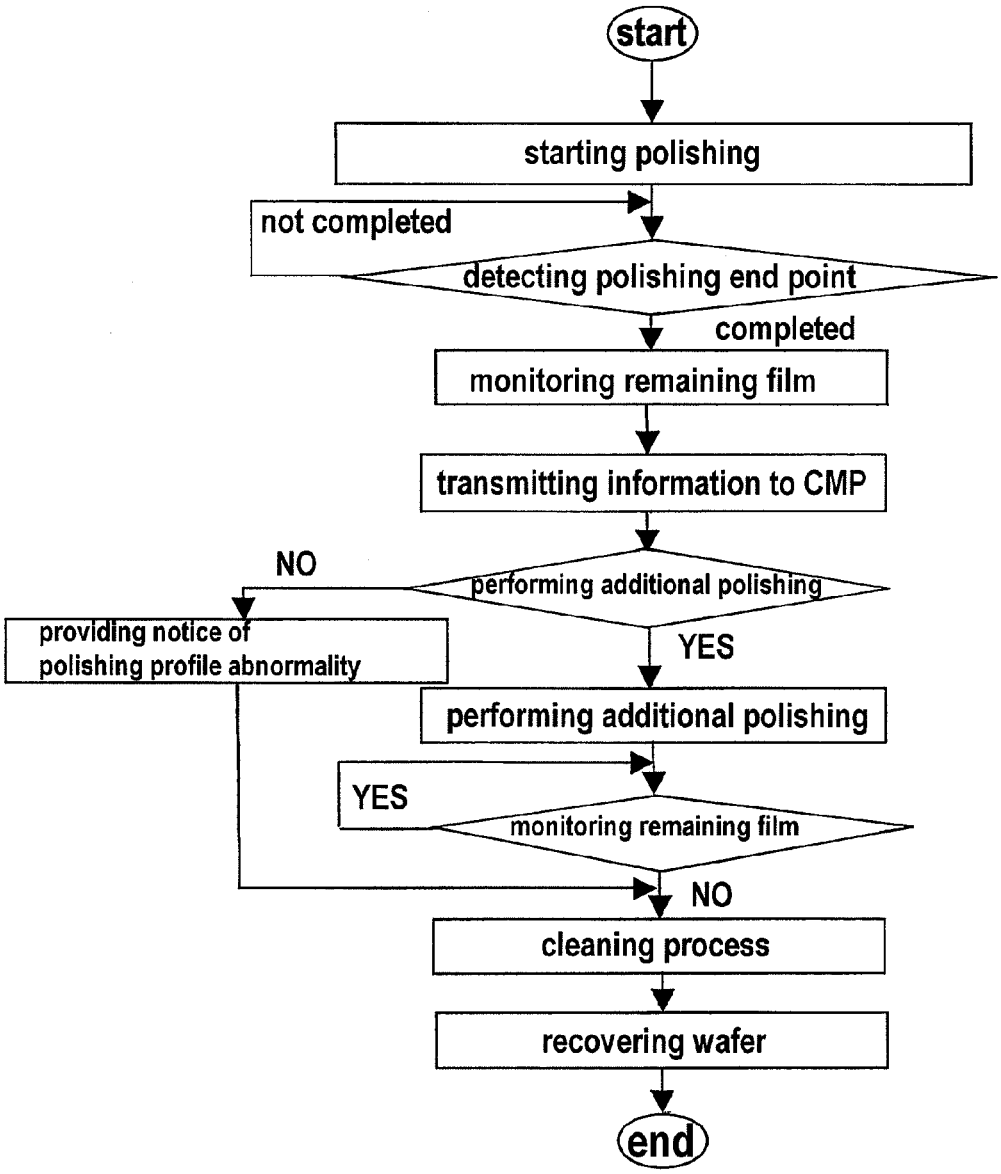
FIG. 15 is a flow chart showing a procedure of a polishing process and a monitoring process of a metal film (or conductive film) mf on the semiconductor wafer.

FIG. 15 is a flow chart showing a procedure of a polishing process and a monitoring process of a metal film (or conductive film) mf on the semiconductor wafer W.

As shown in FIG. 15, in the polishing apparatus, a semiconductor wafer W is takes out from a wafer cassette and transferred to the top ring 1, and the semiconductor wafer W is pressed against the polishing surface 101*a* on the polishing table 100 by the top ring 1, thereby starting polishing of the semiconductor wafer W. After polishing is started, the controller 56 monitors the output values of the eddy current sensor 50, and continues polishing until detection of a polishing end point and continues a monitoring process of the output values of the eddy current sensor 50. The detection of the polishing end point is to detect no remaining metal film uniformly on the semiconductor wafer W by detecting that the output value of the eddy current sensor 50 becomes the clear level of the metal film. After the polishing end point is detected, the process is shifted to monitoring of the remaining film without separating the semiconductor wafer W from the polishing surface (polishing pad).

Monitoring of the remaining film is performed by arbitrarily selecting the following methods:

(1) Switching of sensor sensitivity of the eddy current sensor (2) Switching of monitoring method (3) Switching to an optical sensor The remaining film monitoring methods raised in the above (1)-(3) will be described later in detail.

Next, information obtained by monitoring of the remaining film is transmitted to the controller (process controller (not shown)) for controlling the entire CMP process. The controller (process controller) for controlling the entire CMP process may comprise a single controller including the above controller 56 or a controller different from the controller 56. The controller (process controller) judges whether or not additional polishing is necessary on the basis of the information of monitoring of the remaining film. If it is judged that the additional polishing is necessary, the additional polishing is performed, and the monitoring of the remaining film is performed. Then, after it is confirmed that there is no remaining film, the process is shifted to a cleaning process. On the other hand, if it is judged that the CMP process has some trouble, the additional polishing is not performed, but a notice of polishing profile abnormality is provided, and then the process is shifted to the cleaning process. The cleaning process is performed such that after the polished semiconductor wafer is removed from the top ring 1, scrubbing cleaning, deionized water cleaning, drying and the like are carried out by a cleaning machine in the polishing apparatus. After the cleaning process is terminated, the polished semiconductor wafer W is recovered into the wafer cassette.

Next, the monitoring of the remaining film and the additional polishing in the flow chart shown in FIG. 15 will be further described.

The monitoring of the remaining film is performed during water-polishing or overpolishing after the substantial polishing process of the wafer. Here, the water-polishing is defined as "polishing is performed by small surface pressure applied to the wafer while supplying deionized water (water) to the polishing surface." Further, the overpolishing is defined as "after detecting a characteristic point, polishing is performed while a slurry is supplied to the polishing surface."

The monitoring of the remaining film is performed using the following methods:

(1) A method of performing the monitoring of the remaining film by increasing sensor sensitivity for the purpose of detecting a thin metal film (2) A detection method of shifting a range where monitoring is performed for detecting a local remaining film from an average of accumulation value of point data to point data.

(3) A method of monitoring the remaining film using an optical sensor which is insusceptible to the lower layer of the wafer.

The monitoring of the remaining film is performed by combining the above (1), (2) and (3) arbitrarily. In this case, it is possible to detect a thin metal film in a local area by combining the above (1) and (2) methods. Further, the above method (3) may be performed in parallel.

Further, in the case of detecting the remaining film, the additional polishing is performed in the following manner.

As a means for performing the additional polishing, in the case where the remaining film is detected during overpolishing, the polishing time of the overpolishing is changed. Further, in the case where the remaining film is detected at a specific location on the wafer by the monitoring of the remaining film, the additional polishing is performed by changing pressure of the top ring at the detected specific location, or the additional polishing is performed under a dedicated polishing condition. The additional polishing condition is fed back to a polishing condition for polishing a subsequent semiconductor wafer and thereafter.

Next, among the remaining film monitoring methods, the method of performing the monitoring of the remaining film by increasing sensor sensitivity for the purpose of detecting the thin metal film will be described in detail.

In the case where only a sensor (sensor A) having a certain sensitivity is used from the start of polishing until clearing of a target metal film, it is difficult to detect the metal film if the target metal film becomes thin or an area of the target metal film becomes small. On the other hand, in the case where detection of a polishing end point is performed using only a sensor for thin film (sensor B), if an initial metal film is thick, outputs become over-range (out of measurement range), and thus the polishing process cannot be monitored.

Therefore, according to the present invention, the two sensors A and B having different sensitivity are used, and outputs of the sensor A are monitored from the start of polishing until the sensor A has no sensitivity, and then detection of a polishing end point is performed. Thereafter, the sensor is switched from the sensor A to the sensor B, and it is confirmed that there is no remaining metal film on the wafer. In order to increase the sensitivity of the eddy current sensor, a means for increasing oscillation frequency, increasing amplitude of a receiving circuit, or the like is taken. An increase in exciting voltage improves S/N ratio.

Figure 16:
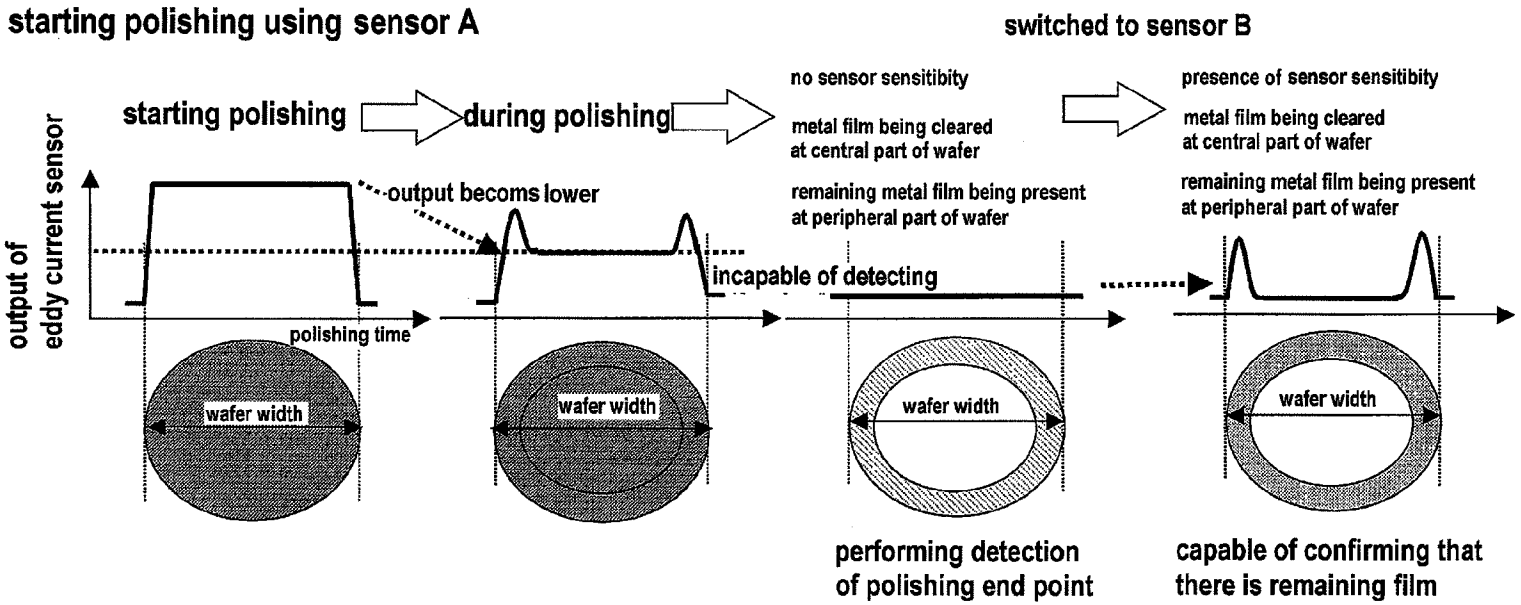
FIG. 16 is a schematic view showing a timing of switching of the sensor in the method of performing the monitoring of the remaining film by increasing sensor sensitivity for the purpose of detecting the thin metal film.

FIG. 16 is a schematic view showing a timing of switching of the sensor in the method of performing the monitoring of the remaining film by increasing sensor sensitivity for the purpose of detecting the thin metal film. As shown in FIG. 16, because the metal film (or conductive film) mf is thick at the start of polishing of the semiconductor wafer W, an output of the eddy current sensor A becomes high. Then, with progress of polishing, the metal film mf becomes thinner and the output of the eddy current sensor A becomes lower. Then, when the state of "the metal film being cleared at the central part of the wafer/the remaining metal film being present at the peripheral part of the wafer" occurs, the eddy current sensor A becomes the state of no sensor sensitivity. Therefore, the eddy current sensor A performs detection of the polishing end point. After the eddy current sensor A performs detection of the polishing end point, the eddy current sensor is switched from the eddy current sensor A to the eddy current sensor B. Because the eddy current sensor B has higher sensitivity than the eddy current sensor A, the output value at the peripheral side of the wafer becomes large in the form of a mountain, and thus the sensor B can detect the state of "the metal film being cleared at the central part of the wafer/the remaining metal film being present at the peripheral part of the wafer." In FIG. 16, the two sensors A and B having different sensitivity are used, and outputs are monitored from the start of polishing until the sensor A has no sensitivity, and then detection of the polishing end point is performed. Thereafter, the sensor is switched from the sensor A to the sensor B, and it is confirmed that there is no remaining metal film on the wafer. However, the same sensor (only the sensor A) is used so that the sensor sensitivity is capable of switching in two stages of high sensitivity and low sensitivity, and the low sensor sensitivity may be used until detection of the polishing end point and the high sensor sensitivity may be used after the detection of the polishing end point.

Next, among the remaining film monitoring methods, the method of switching the monitoring means for the purpose of detecting the local remaining film on the wafer will be described in detail.

In order to obtain information about generation location of the remaining film, a size of the remaining film and a film thickness of the remaining film, the monitoring method is switched from monitoring based on an output value obtained by averaging data at all measuring points obtained by one scanning to monitoring based on output values at respective measuring points. In the case where there is a remaining film which is located not at the entire circumferential area but at the local area, when the remaining film passes through on the locus of the sensor, the output value is changed. The distance from the edge portion (or center) of the wafer can be grasped from the change in the output value. In this case, it is possible to monitor the thin metal film by switching sensor sensitivity.

Figure 17A:
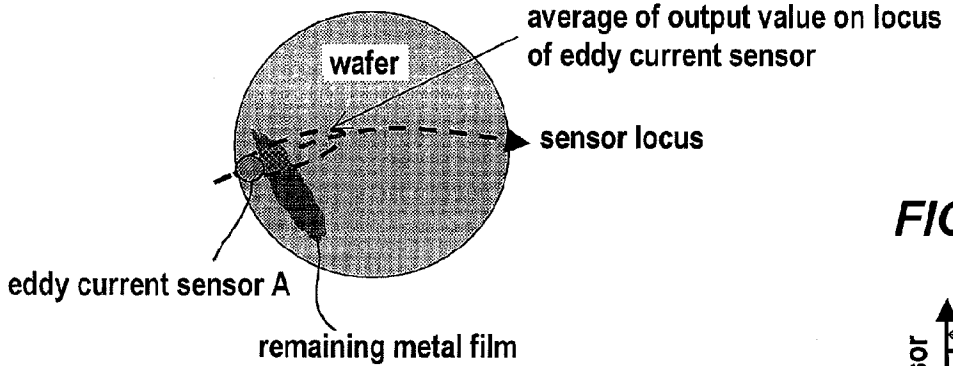
FIG. 17A is a view showing a method of changing a monitoring means for the purpose of detecting the local remaining film on the wafer and showing a monitoring means which uses an output value obtained by averaging data at all measuring points on the sensor locus obtained by one scanning.
Figure 17B:
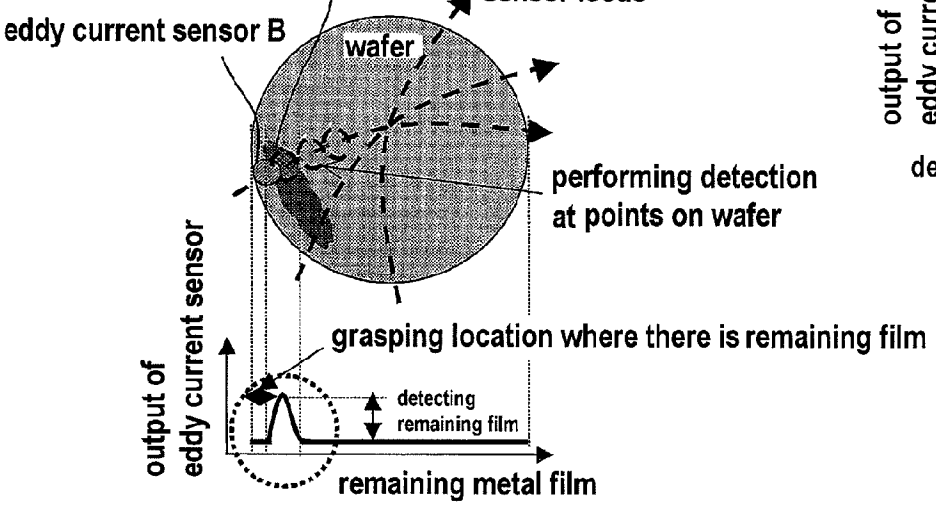
FIG. 17B is a view showing a method of changing a monitoring means for the purpose of detecting the local remaining film on the wafer and showing a monitoring means which uses output values at respective measuring points on the sensor locus obtained by one scanning.
Figure 17C:
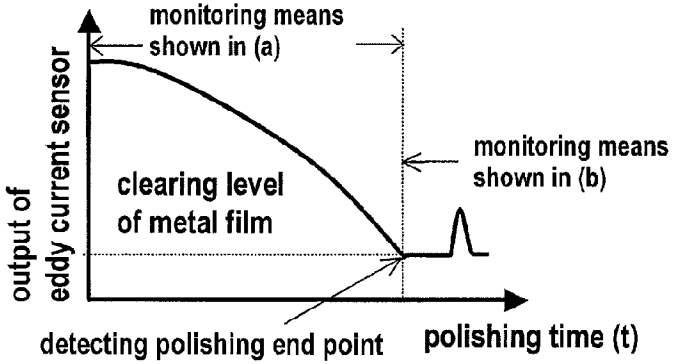
FIG. 17C is a graph showing the case in which the monitoring means is switched from the monitoring means shown in FIG. 17A to the monitoring means shown in FIG. 17B.

FIGS. 17A and 17 B are views showing a method of changing the monitoring means for the purpose of detecting the local remaining film on the wafer. FIG. 17A shows a monitoring means which uses an output value obtained by averaging data at all measuring points on the sensor locus obtained by one scanning, FIG. 17B shows a monitoring means which uses output values at respective measuring points on the sensor locus obtained by one scanning, and FIG. 17C is a graph showing the case in which the monitoring means is switched from the monitoring means shown in FIG. 17A to the monitoring means shown in FIG. 17B. In FIG. 17C, the horizontal axis represents polishing time (t), and the vertical axis represents output values (voltage value) (V) of the eddy current sensor.

As shown in FIG. 17A, every time the eddy current sensor 50 scans the surface of the semiconductor wafer one time, monitoring is performed using an output value obtained by averaging data measured at all measuring points. Then, as shown in FIG. 17C, detection of a polishing end point is performed by monitoring the output value obtained by averaging data at all measuring points on the locus of the eddy current sensor A. When the detection of the polishing end point is performed by the eddy current sensor A, clearing level of the metal film is reached. In this case, the thin metal film having a small local area cannot be detected because the output values at such small local area are averaged.

Therefore, after the polishing end point is detected, the eddy current sensor is switched from the eddy current sensor A to the eddy current sensor B. As shown in FIG. 17B, every time the eddy current sensor B scans the surface of the semiconductor wafer one time, the eddy current sensor B generates output values measured at respective measuring points. Thus, in the case where there is a remaining film, the eddy current sensor B generates output values in the form of a mountain as shown at the lower part of FIG. 17B, and hence it is possible to detect the thin metal film. Further, it is possible to grasp the location where there is a remaining film. Specifically, as shown in FIG. 17C, after the polishing end point is detected by monitoring the output value obtained by averaging the outputs of the eddy current sensor A, the eddy current sensor is switched from the eddy current sensor A to the eddy current sensor B, and then the remaining film having a local small area can be detected by monitoring the output values of the respective measuring values which are not averaged in the eddy current sensor B. In FIGS. 17A, 17B and 17C, detection of the polishing end point and detection of the remaining film are performed using the sensor A which averages data at the respective measuring points and the sensor B which does not average data at the respective measuring points but generates the output values without modification. However, it is possible to switch between the case of averaging processing and the case of no averaging processing using the same sensor (only the sensor A), and the averaging processing is performed until detection of the polishing end point and the averaging processing is not performed after detection of the polishing end point.

Figure 18B:
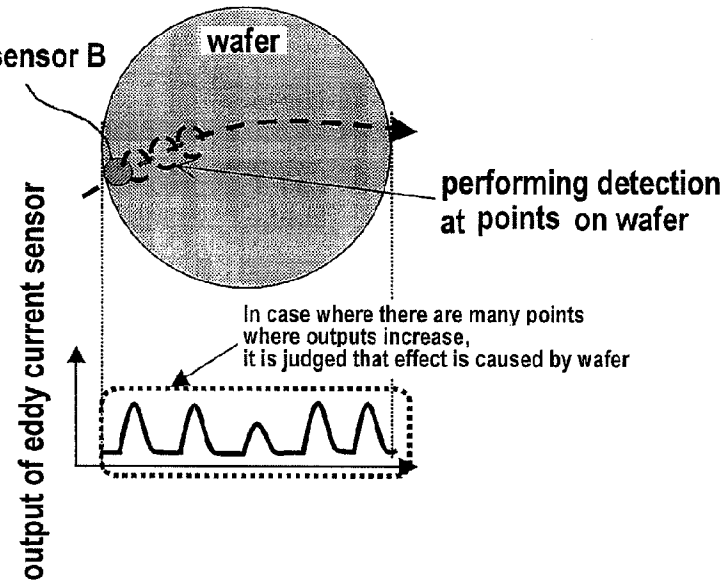
FIG. 18B is a view showing an effect of metal interconnections or the like located at the lower layer of the wafer in the case of detecting generation of the local remaining film by monitoring output values of respective measuring values obtained by the eddy current sensor and showing the case in which there is an effect of the metal interconnections or the like located at the lower layer of the wafer.
Figure 18A:
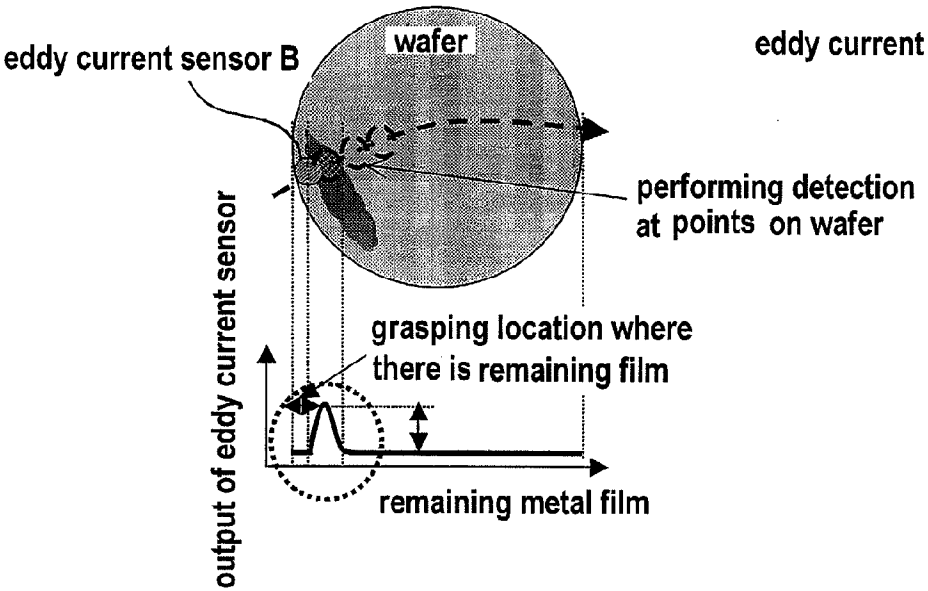
FIG. 18A is a view showing an effect of metal interconnections or the like located at the lower layer of the wafer in the case of detecting generation of the local remaining film by monitoring output values of respective measuring values obtained by the eddy current sensor and showing the case in which there is no effect of the lower layer of the wafer.

FIGS. 18A and 18B are views showing an effect of metal interconnections or the like located at the lower layer of the wafer in the case of detecting generation of the local remaining film by monitoring output values of respective measuring values obtained by the eddy current sensor B. FIG. 18A shows the case in which there is no effect of the lower layer of the wafer, and FIG. 18B shows the case in which there is an effect of the metal interconnections or the like located at the lower layer of the wafer.

As described above, it is possible to avoid an effect of the metal interconnections located at the lower layer of the wafer by averaging outputs on the locus of the sensor passing through the wafer plane. On the other hand, because the eddy current sensor B generates the output values measured at respective measuring points, as shown in FIG. 18A, generation of the remaining film having a small local area can be detected by monitoring output values of the respective measuring values obtained by the eddy current sensor B without averaging processing. However, because the output values of the eddy current sensor B correspond to output values at the respective measuring points, there is a possibility that there is an effect of the metal interconnections or the like located at the lower layer of the wafer. Therefore, as shown in FIG. 18B, in the case where there are many points where the outputs increases, it is judged that the effect is caused not by the remaining film but by the lower layer of the wafer.

Next, among the remaining film monitoring methods, the method of monitoring a remaining film using an optical sensor will be described in detail. As shown in FIG. 17A, every time the eddy current sensor scans the surface of the semiconductor wafer one time, monitoring is performed using an output value obtained by averaging data measured at all measuring points. Then, the polishing end point is detected by monitoring an output value obtained by averaging data at all measuring points on the locus of the eddy current sensor. When the polishing end point is detected by the eddy current sensor, clearing level of the metal film is reached. After the polishing end point is detected, the sensor is switched from the eddy current sensor to an optical sensor separately provided in the polishing table.

The optical sensor comprises a light-emitting element and a light-detecting element, and the light-emitting element applies light to the surface, being polished, of the semiconductor wafer W and the light-detecting element receives reflected light from the surface being polished. In this case, the light-emitting element may apply a laser beam or light of LED to the surface of the semiconductor wafer. In some cases, the light-emitting element may utilize white light. The polishing pad 101 (see FIG. 1) has a cylindrical light-transmittable window member mounted therein for allowing light from the optical sensor to pass therethrough. Alternatively, a small through-hole is provided in the polishing pad 101, and when the through-hole comes under the wafer, a space surrounded by the through-hole and the wafer surface may be filled with liquid having light transmitting capability.

In many cases, the remaining film of the metal member such as Cu is in the form of a circular line or spots on the wafer surface, and thus it is possible to distinguish color of the remaining film visually. Therefore, in the case of Cu, for example, by applying light having a high reflectance wavelength of about 700 to 800 nm, or monitoring a reflected light in view of the light having the same wavelength while the light-transmittable window member or the through-hole monitors under the wafer, the remaining film at the local area can be detected by capturing the timing when the reflection intensity increases temporarily.

Next, a method capable of selecting the case where additional polishing is performed by the CMP or the case where a notice of polishing profile abnormality is provided in the case where the remaining film is detected in the remaining film monitoring process in the flow chart shown in FIG. 15 will be described in detail.

In the case where the remaining film is detected by the remaining film monitoring process, the additional polishing is usually performed to remove the metal film. However, in some case, the CMP process has some trouble even if planarization of the wafer is kept by the additional polishing, and hence a notice of the polishing profile abnormality can be given to the controller of the polishing apparatus.

Next, a locus (scanning line) described when the eddy current sensor 50 scans a surface of the semiconductor wafer will be described.

Thus, in the present invention, a ratio of the rotational speeds of the top ring 1 and the polishing table 100 is adjusted such that the loci of the eddy current sensor 50 described on the semiconductor wafer W within a predetermined period of time (e.g., within a moving average time) are distributed substantially evenly over an entire circumference of the surface of the semiconductor wafer W.

Figure 19:
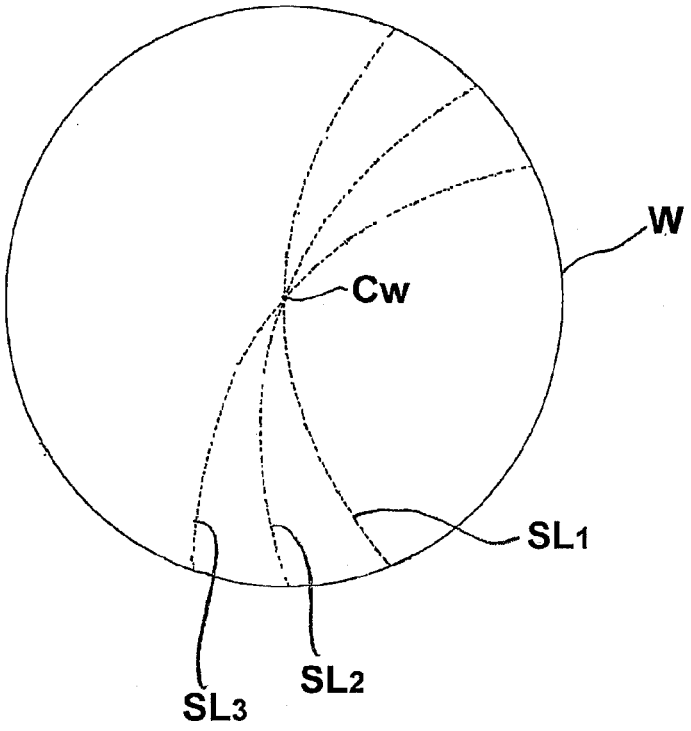
FIG. 19 is a schematic view showing loci of the eddy current sensor sweeping across the semiconductor wafer.

FIG. 19 is a schematic view showing loci of the eddy current sensor 50 sweeping across the semiconductor wafer W. As shown in FIG. 19, the eddy current sensor 50 scans the surface (surface to be polished) of the semiconductor wafer W each time the polishing table 100 makes one revolution. Specifically, when the polishing table 100 is being rotated, the eddy current sensor 50 sweeps across the surface, being polished, of the semiconductor wafer W in a locus passing through the center $C_w$ of the semiconductor wafer W (center of the top ring shaft 111). A rotational speed of the top ring 1 is set to be different from a rotational speed of the polishing table 100. Therefore, the locus of the eddy current sensor 50 described on the surface of the semiconductor wafer W changes as the polishing table 100 rotates, as indicated by scanning lines $SL_1$, $SL_2$, $SL_3$, . . . in FIG. 19. Even in this case, since the eddy current sensor 50 is located so as to pass through the center $C_w$ of the semiconductor wafer W as described above, the locus of the eddy current sensor 50 passes through the center $C_w$ of the semiconductor wafer W in every rotation.

Figure 20:
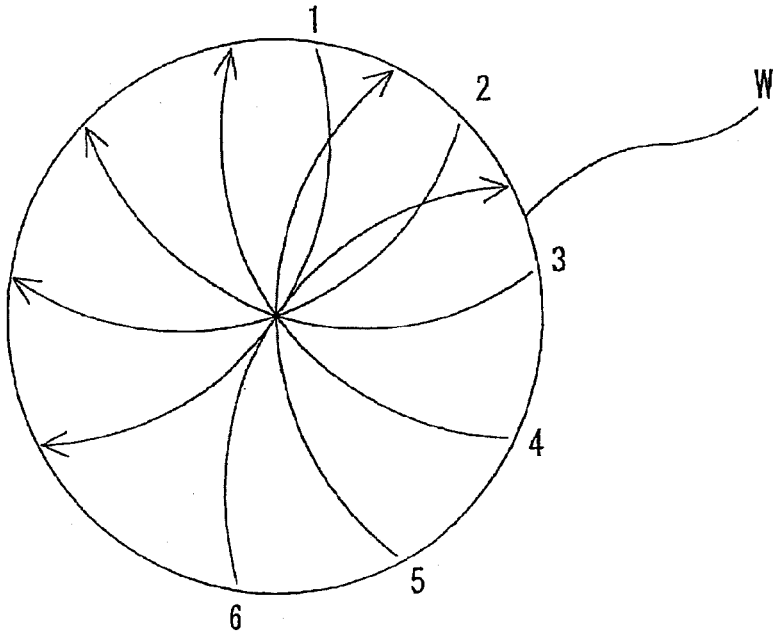
FIG. 20 is a schematic view showing loci of the eddy current sensor sweeping across the semiconductor wafer.

FIG. 20 is a view showing the loci of the eddy current sensor 50 described on the semiconductor wafer within the moving average time (5 seconds in this example) in the case where the rotational speed of the polishing table 100 is 70 $min^{-1}$ and the rotational speed of the top ring 1 is 77 $min^{-1}$. As shown in FIG. 20, under these conditions, the locus of the eddy current sensor 50 rotates by 36 degrees each time the polishing table 100 makes one revolution. Therefore, the locus of the eddy current sensor 50 rotates by half of the circumference of the semiconductor wafer W every time the eddy current sensor 50 scans five times. In view of a curvature of the sensor locus, six-time sweep motions of the eddy current sensor 50 across the semiconductor wafer W within the moving average time allow the eddy current sensor 50 to scan the entire surface of the semiconductor wafer W substantially evenly.

While the rotational speed of the top ring 1 is higher than the rotational speed of the polishing table 100 in the above-described example, the rotational speed of the top ring 1 may be lower than the rotational speed of the polishing table 100 (for example, the rotational speed of the polishing table 100 may be set to 70 $min^{-1}$ and the rotational speed of the top ring 1 may be set to 63 $min^{-1}$). In this case, the sensor locus rotates in the opposite direction, but the loci of the eddy current sensor 50 described on the surface of the semiconductor wafer W within the predetermined period of time are distributed over the entire circumference of the surface of the semiconductor wafer W as well as the above example.

Further, while the ratio of the rotational speeds of the top ring 1 and the polishing table 100 is close to 1 in the above-described example, the ratio of the rotational speeds may be close to 0.5, 1.5, or 2 (i.e., a multiple of 0.5). In this case also, the same results can be obtained. For example, when the ratio of the rotational speeds of the top ring 1 and the polishing table 100 is set to 0.5, the sensor locus rotates by 180 degrees each time the polishing table 100 makes one revolution. When viewed from the semiconductor wafer W, the eddy current sensor 50 moves along the same locus in the opposite direction each time the polishing table 100 makes one revolution.

The ratio of the rotational speeds of the top ring 1 and the polishing table 100 may be slightly shifted from 0.5 (for example, the rotational speed of the top ring 1 may be set to 36 $min^{-1}$ and the rotational speed of the polishing table 100 may be set to 70 $min^{-1}$), so that the sensor locus rotates by $180+\alpha$ degrees each time the polishing table 100 makes one revolution. In this case, the sensor locus is shifted by an apparent angle of $\alpha$ degree(s). Therefore, it is possible to establish the value of $\alpha$ (i.e., the ratio of the rotational speeds of the top ring 1 and the polishing table 100) such that the sensor locus rotates about 0.5 time, or about N time(s), or about 0.5+N times (in other words, a multiple of 0.5, i.e., 0.5×N time(s) (N is a natural number)) on the surface of the semiconductor wafer W within the moving average time.

This method of distributing the loci of the eddy current sensor 50 on the surface of the semiconductor wafer W substantially evenly over the entire circumference of the semiconductor wafer W within the moving average time can allow wide selection of the ratio of the rotational speeds, in consideration of the adjustment of the moving average time. Therefore, this method can be applied to a polishing process which requires great variation of the ratio of the rotational speeds of the top ring 1 and the polishing table 100 in accordance with polishing conditions such as characteristics of a polishing liquid (slurry).

Figure 21:
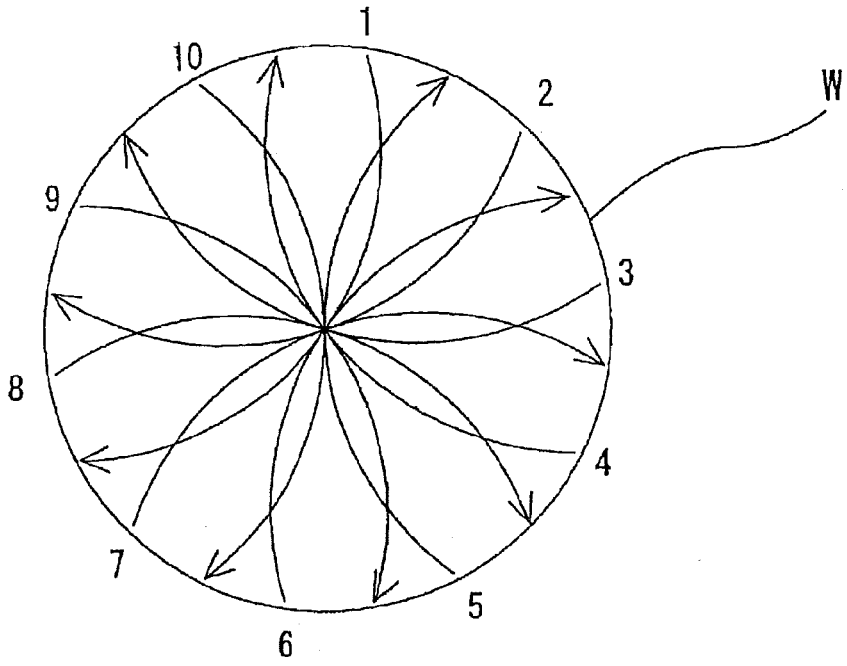
FIG. 21 is a schematic view showing loci of the eddy current sensor sweeping across the semiconductor wafer.

Generally, the locus of the eddy current sensor 50 described on the semiconductor wafer W is curved as shown in FIG. 20, except in a case where the rotational speed of the top ring 1 is just half the rotational speed of the polishing table 100. Therefore, even when the loci of the eddy current sensor 50 on the surface of the semiconductor wafer W are distributed over the entire circumference of the semiconductor wafer W within a predetermined time (e.g., the moving average time), these sensor loci are not evenly distributed in the circumferential direction of the semiconductor wafer W in a strict sense. To exactly distribute the sensor loci evenly in the circumferential direction of the semiconductor wafer W, it is necessary that the sensor locus rotates just N time (s) (N is a natural number) on the semiconductor wafer W in every predetermined period of time. During this period of time, the eddy current sensor 50 scans the surface of the semiconductor wafer W in directions or orientations that are distributed evenly in the circumferential direction of the semiconductor wafer W over the entire circumference thereof. To realize this, the rotational speeds of the polishing table 100 and the top ring 1 are determined such that, while the polishing table 100 makes a predetermined number (natural number) of revolutions, the top ring 1 makes just a predetermined number (natural number) of revolutions that is different from the predetermined number of revolutions of the polishing table 100. In this case also, since the sensor loci are curved as described above, it cannot be said that these loci are distributed at equal intervals in the circumferential direction. However, supposing that every two sensor loci make one pair, the sensor loci can be regarded as being distributed evenly in the circumferential direction at an arbitrary radial position. FIG. 21 shows this example. Specifically, FIG. 21 is a view showing the sensor loci on the semiconductor wafer W while the polishing table 100 makes ten revolutions under the same conditions as those in FIG. 20. As can be understood from the above description, the eddy current sensor 50 can obtain data that more evenly reflect various structures of the entire surface of the semiconductor wafer W, compared with the above example.

Next, the top ring 1 which is suitably used in the polishing apparatus according to the present invention will be described below in detail. FIGS. 22 through 26 are cross-sectional views showing the top ring 1 along a plurality of radial directions of the top ring 1.

Figure 22:
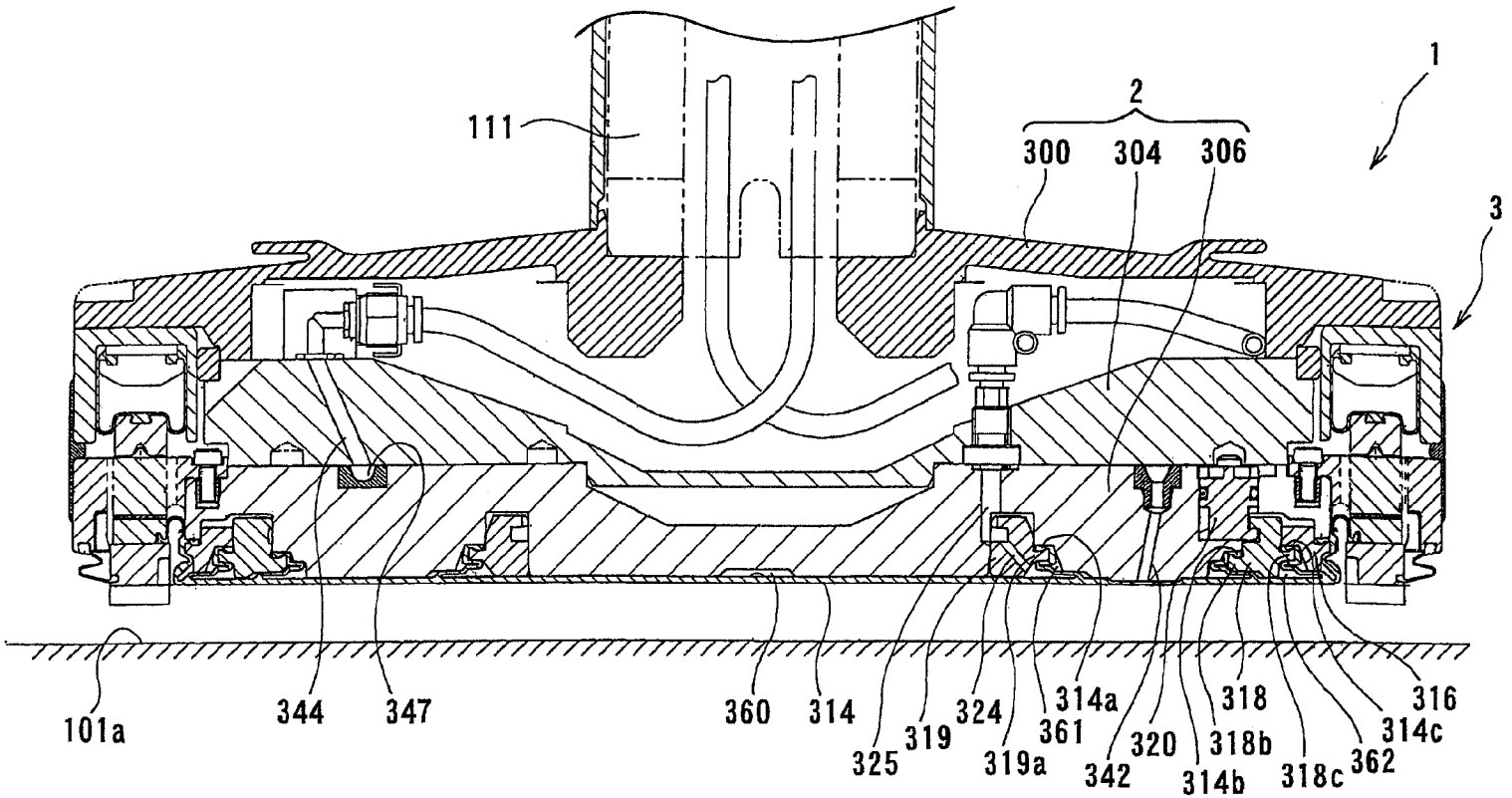
FIG. 22 is a cross-sectional view showing an example of a structure of the top ring shown in FIG. 1.
Figure 23:
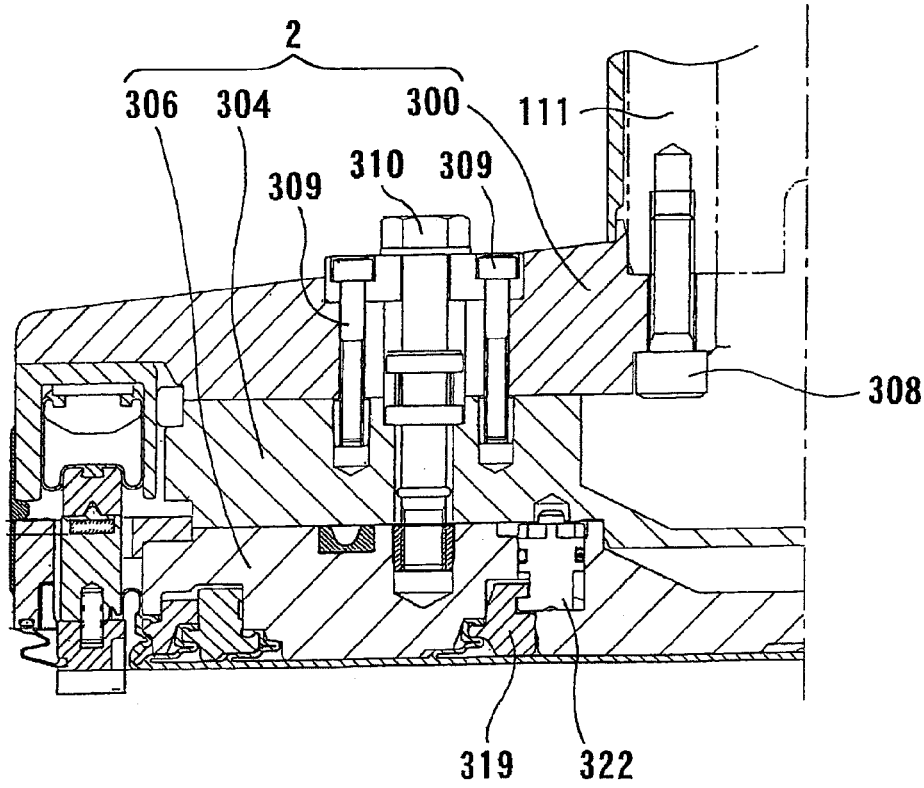
FIG. 23 is a cross-sectional view showing an example of a structure of the top ring shown in FIG. 1.

As shown in FIG. 22, the top ring 1 basically comprises a top ring body 2 for pressing a semiconductor wafer W against the polishing surface 101*a*, and a retainer ring 3 for directly pressing the polishing surface 101*a*. The top ring body 2 includes an upper member 300 in the form of a circular plate, an intermediate member 304 attached to a lower surface of the upper member 300, and a lower member 306 attached to a lower surface of the intermediate member 304. The retainer ring 3 is attached to a peripheral portion of the upper member 300 of the top ring body 2. As shown in FIG. 23, the upper member 300 is connected to the top ring shaft 111 by bolts 308. Further, the intermediate member 304 is fixed to the upper member 300 by bolts 309, and the lower member 306 is fixed to the upper member 300 by bolts 310. The top ring body 2 including the upper member 300, the intermediate member 304, and the lower member 306 is made of resin such as engineering plastics (e.g. PEEK).

As shown in FIG. 22, the top ring 1 has an elastic membrane 314 attached to a lower surface of the lower member 306. The elastic membrane 314 is brought into contact with a rear face of a semiconductor wafer. The elastic membrane 314 is held on the lower surface of the lower member 306 by an annular edge holder 316 disposed radially outward and annular ripple holders 318 and 319 disposed radially inward of the edge holder 316. The elastic membrane 314 is made of a highly strong and durable rubber material such as ethylene propylene rubber (EPDM), polyurethane rubber, silicone rubber, or the like.

The edge holder 316 is held by the ripple holder 318, and the ripple holder 318 is held on the lower surface of the lower member 306 by a plurality of stoppers 320. As shown in FIG. 23, the ripple holder 319 is held on the lower surface of the lower member 306 by a plurality of stoppers 322. The stoppers 320 and the stoppers 322 are arranged along a circumferential direction of the top ring 1 at equal intervals.

As shown in FIG. 22, a central chamber 360 is formed at a central portion of the elastic membrane 314. The ripple holder 319 has a passage 324 communicating with the central chamber 360. The lower member 306 has a passage 325 communicating with the passage 324. The passage 324 of the ripple holder 319 and the passage 325 of the lower member 306 are connected to a fluid supply source (not shown). Thus, a pressurized fluid is supplied through the passages 325 and 324 to the central chamber 360.

The ripple holder 318 has claws 318*b* and 318*c* for pressing a ripple 314*b* and an edge 314*c* of the elastic membrane 314 against the lower surface of the lower member 306. The ripple holder 319 has a claw 319*a* for pressing a ripple 314*a* of the elastic membrane 314 against the lower surface of the lower member 306.

Figure 24:
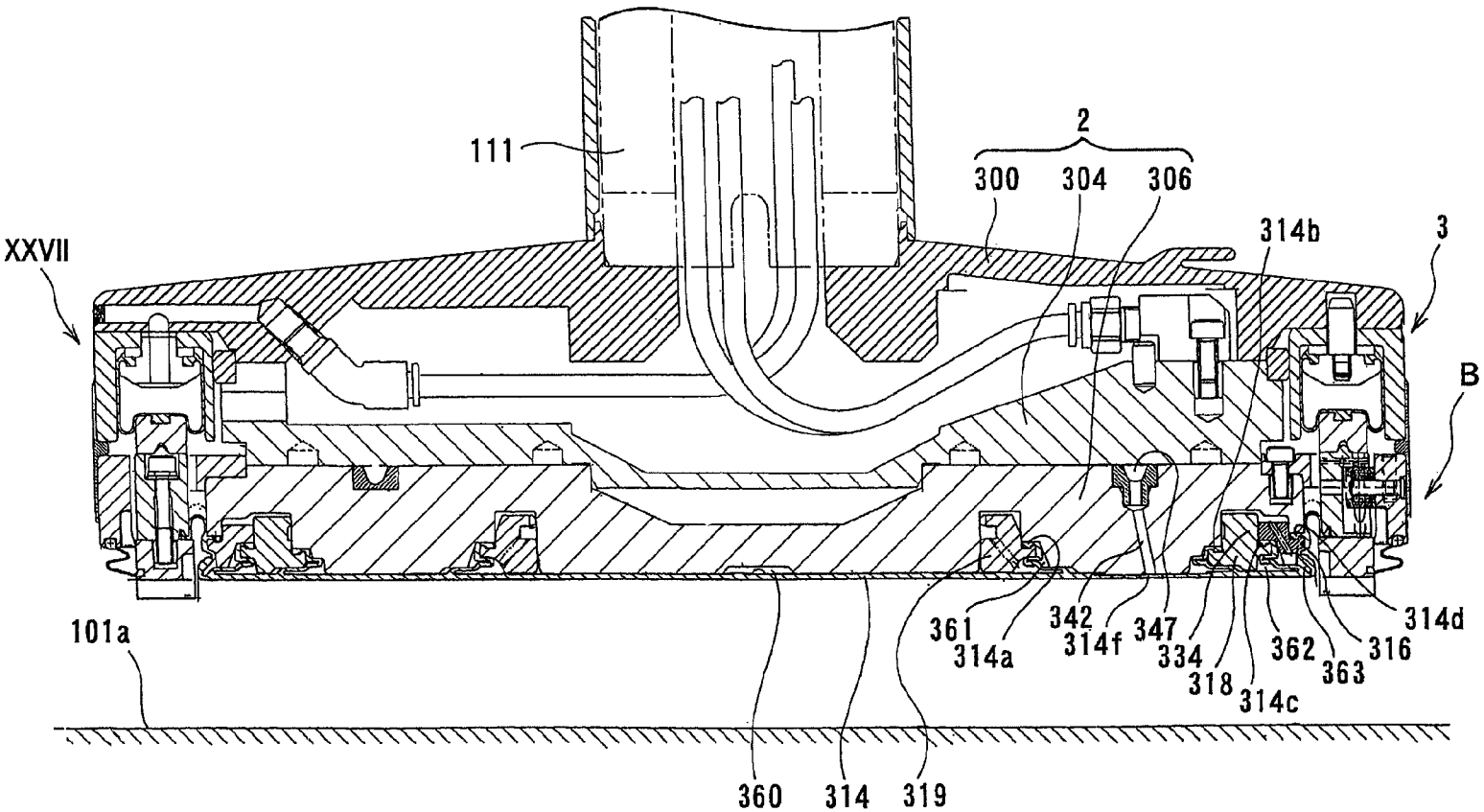
FIG. 24 is a cross-sectional view showing an example of a structure of the top ring shown in FIG. 1.

As shown in FIG. 24, an annular ripple chamber 361 is formed between the ripple 314*a* and the ripple 314*b* of the elastic membrane 314. A gap 314*f* is formed between the ripple holder 318 and the ripple holder 319 of the elastic membrane 314. The lower member 306 has a passage 342 communicating with the gap 314*f*. Further, as shown in FIG. 22, the intermediate member 304 has a passage 344 communicating with the passage 342 of the lower member 306. An annular groove 347 is formed at a connecting portion between the passage 342 of the lower member 306 and the passage 344 of the intermediate member 304. The passage 342 of the lower member 306 is connected via the annular groove 347 and the passage 344 of the intermediate member 304 to a fluid supply source (not shown). Thus, a pressurized fluid is supplied through the passages to the ripple chamber 361. Further, the passage 342 is selectively connected to a vacuum pump (not shown). When the vacuum pump is operated, a semiconductor wafer is attached to the lower surface of the elastic membrane 314 by suction.

Figure 25:
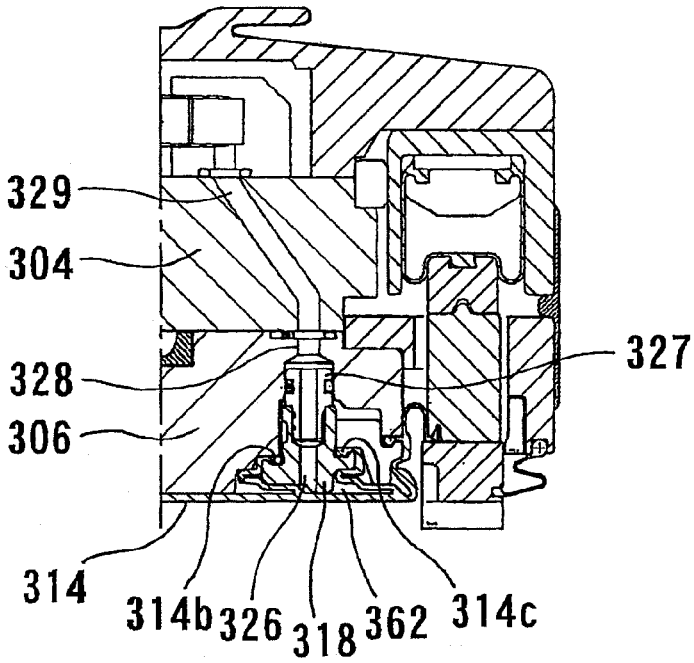
FIG. 25 is a cross-sectional view showing an example of a structure of the top ring shown in FIG. 1.

As shown in FIG. 25, the ripple holder 318 has a passage 326 communicating with an annular outer chamber 362 formed by the ripple 314*b* and the edge 314*c* of the elastic membrane 314. Further, the lower member 306 has a passage 328 communicating with the passage 326 of the ripple holder 318 via a connector 327. The intermediate member 304 has a passage 329 communicating with the passage 328 of the lower member 306. The passage 326 of the ripple holder 318 is connected via the passage 328 of the lower member 306 and the passage 329 of the intermediate member 304 to a fluid supply source (not shown). Thus, a pressurized fluid is supplied through these passages to the outer chamber 362.

Figure 26:
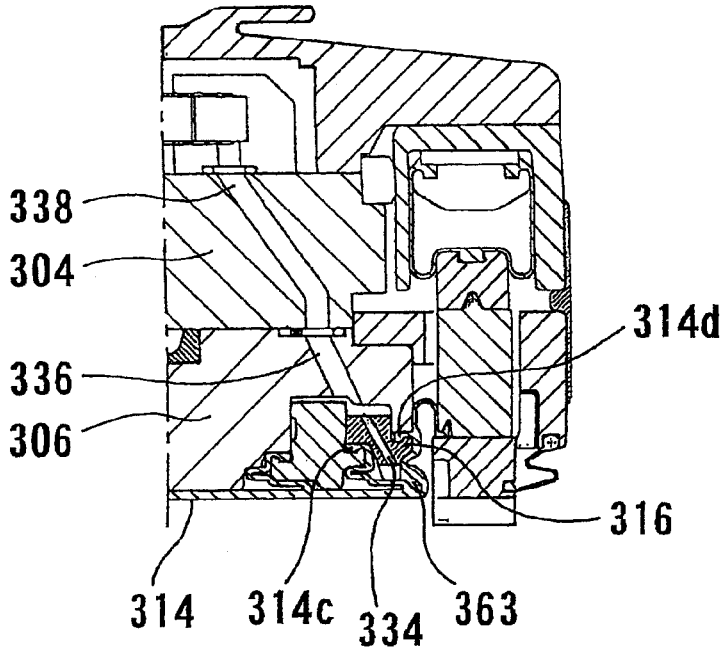
FIG. 26 is a cross-sectional view showing an example of a structure of the top ring shown in FIG. 1.

As shown in FIG. 26, the edge holder 316 is configured to hold an edge 314*d* of the elastic membrane 314 on the lower surface of the lower member 306. The edge holder 316 has a passage 334 communicating with an annular edge chamber 363 formed by the edges 314*c* and 314*d* of the elastic membrane 314. The lower member 306 has a passage 336 communicating with the passage 334 of the edge holder 316. The intermediate member 304 has a passage 338 communicating with the passage 336 of the lower member 306. The passage 334 of the edge holder 316 is connected via the passage 336 of the lower member 306 and the passage 338 of the intermediate member 304 to a fluid supply source. Thus, a pressurized fluid is supplied through these passages to the edge chamber 363.

As described above, according to the top ring 1 in the present embodiment, pressing forces for pressing a semiconductor wafer against the polishing pad 101 can be adjusted at local areas of the semiconductor wafer by adjusting pressures of fluids to be supplied to the respective pressure chambers, i.e. the central chamber 360, the ripple chamber 361, the outer chamber 362, and the edge chamber 363, formed between the elastic membrane 314 and the lower member 306.

Figure 27:
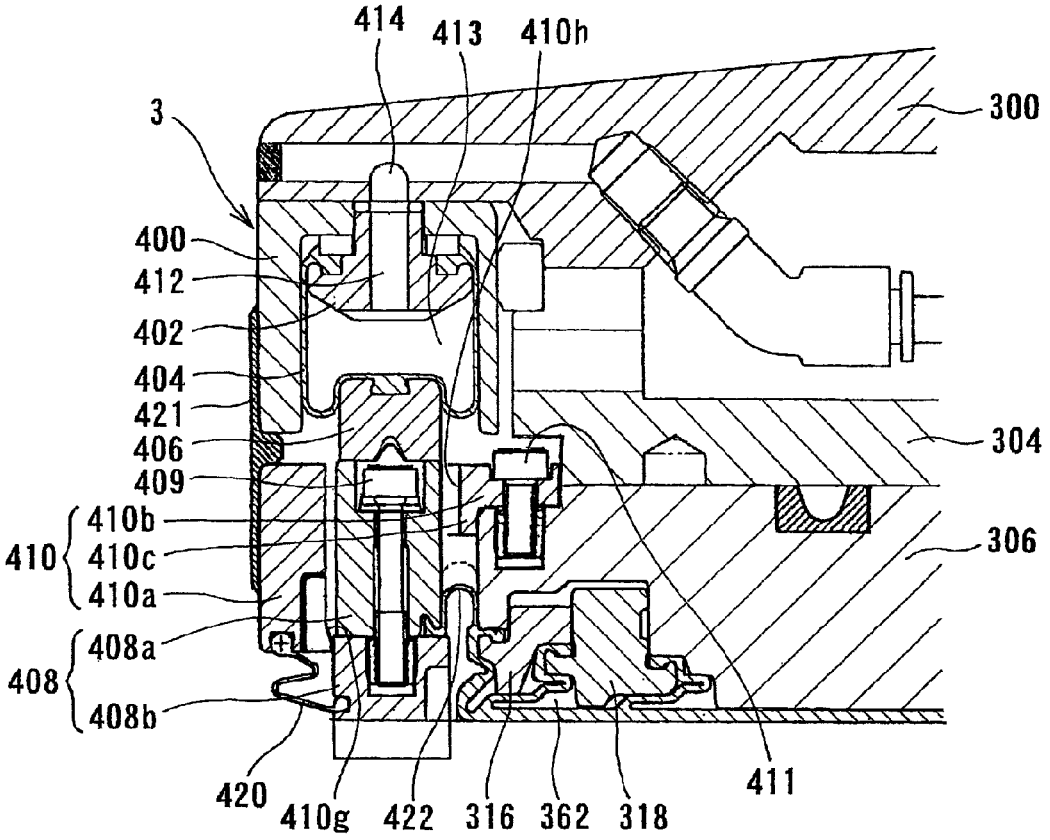
FIG. 27 is an enlarged view of XXVII part of the retainer ring shown in FIG. 24.

FIG. 27 is an enlarged view of XXVII part of the retainer ring shown in FIG. 24. The retainer ring 3 serves to hold a peripheral edge of a semiconductor wafer. As shown in FIG. 27, the retainer ring 3 has a cylinder 400 having a cylindrical shape and a closed upper portion, a holder 402 attached to an upper portion of the cylinder 400, an elastic membrane 404 held in the cylinder 400 by the holder 402, a piston 406 connected to a lower end of the elastic membrane 404, and a ring member 408 which is pressed downward by the piston 406.

The ring member 408 comprises an upper ring member 408*a* coupled to the piston 406, and a lower ring member 408*b* which is brought into contact with the polishing surface 101*a*. The upper ring member 408*a* and the lower ring member 408*b* are coupled by a plurality of bolts 409. The upper ring member 408*a* is composed of a metal such as SUS or a material such as ceramics. The lower ring member 408*b* is composed of a resin material such as PEEK or PPS.

As shown in FIG. 27, the holder 402 has a passage 412 communicating with a chamber 413 formed by the elastic membrane 404. The upper member 300 has a passage 414 communicating with the passage 412 of the holder 402. The passage 412 of the holder 402 is connected via the passage 414 of the upper member 300 to a fluid supply source (not shown). Thus, a pressurized fluid is supplied through these passages to the chamber 413. Accordingly, by adjusting a pressure of a fluid to be supplied to the chamber 413, the elastic membrane 404 can be expanded and contracted so as to vertically move the piston 406. Thus, the ring member 408 of the retainer ring 3 can be pressed against the polishing pad 101 under a desired pressure.

In the illustrated example, the elastic membrane 404 employs a rolling diaphragm formed by an elastic membrane having bent portions. When an inner pressure in a chamber defined by the rolling diaphragm is changed, the bent portions of the rolling diaphragm are rolled so as to widen the chamber. The diaphragm is not brought into sliding contact with outside components and is hardly expanded and contracted when the chamber is widened. Accordingly, friction due to sliding contact can extremely be reduced, and a lifetime of the diaphragm can be prolonged. Further, pressing forces under which the retainer ring 3 presses the polishing pad 101 can accurately be adjusted.

With the above arrangement, only the ring member 408 of the retainer ring 3 can be lowered. Accordingly, even if the ring member 408 of the retainer ring 3 is worn out, the distance between the lower member 306 and the polishing pad 101 can be maintained constant. Further, since the ring member 408, which is brought into contact with the polishing pad 101, and the cylinder 400 are connected by the deformable elastic membrane 404, no bending moment is produced by offset loads. Accordingly, surface pressures by the retainer ring 3 can be made uniform, and the retainer ring 3 becomes more likely to follow the polishing pad 101.

Further, as shown in FIG. 27, the retainer ring 3 has a ring-shaped retainer ring guide 410 for guiding vertical movement of the ring member 408. The ring-shaped retainer ring guide 410 comprises an outer peripheral portion 410*a* located at an outer circumferential side of the ring member 408 so as to surround an entire circumference of an upper portion of the ring member 408, an inner peripheral portion 410*b* located at an inner circumferential side of the ring member 408, and an intermediate portion 410*c* configured to connect the outer peripheral portion 410*a* and the inner peripheral portion 410*b*. The inner peripheral portion 410*b* of the retainer ring guide 410 is fixed to the lower member 306 by a plurality of bolts 411. The intermediate portion 410*c* configured to connect the outer peripheral portion 410*a* and the inner peripheral portion 410*b* has a plurality of openings 410*h* which are formed at equal intervals in a circumferential direction of the intermediate portion 410*c*.

Although certain preferred embodiments of the present invention have been shown and described in detail, it should be understood that various changes and modifications may be made therein without departing from the scope of the appended claims. Any shapes, structures, and materials, which are not described directly in the specification and drawings, may be within the scope of the technical concept of the present invention, as long as they have the same effects of the present invention.

What is claimed is:

1. A polishing method of polishing a substrate as an object to be polished by pressing the substrate against a polishing surface on a rotating polishing table, said polishing method comprising:

scanning a surface, being polished, of the substrate by an eddy current sensor provided in the polishing table while the polishing table is rotated, during polishing of the substrate; and monitoring an output of the eddy current sensor obtained by scanning the surface, being polished, of the substrate and detecting damage of the substrate from a change in the output of the eddy current sensor, wherein an effective substrate width is determined from the output of the eddy current sensor in an N-th revolution, N being an integer not less than 1, of the polishing table, a substrate width is determined from the output of the eddy current sensor after the N-th revolution of the polishing table, and when the determined substrate width is narrower than the effective substrate width, it is judged that the damage of the substrate occurs.

2. A polishing method of polishing a substrate as an object to be polished by pressing the substrate against a polishing surface on a rotating polishing table, said polishing method comprising:

scanning a surface, being polished, of the substrate by an eddy current sensor provided in the polishing table while the polishing table is rotated, during polishing of the substrate; and monitoring an output of the eddy current sensor obtained by scanning the surface, being polished, of the substrate and detecting damage of the substrate from a change in the output of the eddy current sensor, wherein the output of the eddy current sensor in an N-th revolution, N being an integer not less than 1, of the polishing table is monitored, and the damage of the substrate is detected by comparing an output value of the eddy current sensor with a preset threshold value.

3. A polishing method according to claim 2, wherein a number of times the output value of the eddy current sensor is not more than the preset threshold value is counted, and when a counter value in a case where the output value is not more than the preset threshold value is within a setting range, it is judged that the damage of the substrate occurs.

4. A polishing method of polishing a substrate as an object to be polished by pressing the substrate against a polishing surface on a rotating polishing table, said polishing method comprising:

scanning a surface, being polished, of the substrate by an eddy current sensor provided in the polishing table while the polishing table is rotated, during polishing of the substrate; and monitoring an output of the eddy current sensor obtained by scanning the surface, being polished, of the substrate and detecting damage of the substrate from a change in the output of the eddy current sensor, wherein the substrate is held and rotated by a top ring, and a rotational speed of the top ring and a rotational speed of the polishing table are set such that loci of scanning the surface, being polished, of the substrate by the eddy current sensor within a predetermined time are distributed substantially evenly over an entire circumference of the surface, being polished, of the substrate.

5. A polishing method according to claim 4, wherein the rotational speed of the top ring and the rotational speed of the polishing table are set such that the loci of scanning the surface, being polished, of the substrate by the eddy current sensor within the predetermined time rotates about 0.5×N times, N being a natural number and not less than 1, on the surface, being polished, of the substrate.

6. A polishing method of polishing a substrate as an object to be polished by holding the substrate and pressing the substrate against a polishing surface on a rotating polishing table by a top ring, said polishing method comprising:

scanning a surface, being polished, of the substrate by an eddy current sensor provided in the polishing table while the polishing table is rotated, during polishing of the substrate; and monitoring an output of the eddy current sensor obtained by scanning the surface, being polished, of the substrate and detecting removal of the substrate from the top ring on a basis of a change in the output of the eddy current sensor, wherein the substrate is held and rotated by a top ring, and a rotational speed of the top ring and a rotational speed of the polishing table are set such that loci of scanning the surface, being polished, of the substrate by the eddy current sensor within a predetermined time are distributed substantially evenly over an entire circumference of the surface, being polished, of the substrate.

7. A polishing method according to claim 6, wherein the rotational speed of the top ring and the rotational speed of the polishing table are set such that the loci of scanning the surface, being polished, of the substrate by the eddy current sensor within the predetermined time rotates about 0.5×N times, N being a natural number and not less than 1, on the surface, being polished, of the substrate.

8. A polishing method of polishing a substrate as an object to be polished by pressing the substrate against a polishing surface on a rotating polishing table, said polishing method comprising:

scanning a surface, being polished, of the substrate by an eddy current sensor provided in the polishing table while the polishing table is rotated, during polishing of the substrate; and monitoring an output of the eddy current sensor obtained by scanning the surface, being polished, of the substrate and detecting damage of the substrate by comparing the output of the eddy current sensor with an output of the eddy current sensor in a case of a normal substrate, wherein the substrate is held and rotated by a top ring, and a rotational speed of the top ring and a rotational speed of the polishing table are set such that loci of scanning the surface, being polished, of the substrate by the eddy current sensor within a predetermined time are distributed substantially evenly over an entire circumference of the surface, being polished, of the substrate.

9. A polishing method according to claim 8, wherein the rotational speed of the top ring and the rotational speed of the polishing table are set such that the loci of scanning the surface, being polished, of the substrate by the eddy current sensor within the predetermined time rotates about 0.5×N times, N being a natural number and not less than 1, on the surface, being polished, of the substrate.

* * * * *